US011204167B2

(12) United States Patent
Uhm et al.

(10) Patent No.: US 11,204,167 B2
(45) Date of Patent: Dec. 21, 2021

(54) GAS TURBINE COMBUSTOR

(71) Applicant: DOOSAN HEAVY INDUSTRIES & CONSTRUCTION CO., LTD., Changwon-si (KR)

(72) Inventors: Jong Ho Uhm, Yongin-si (KR); Geun Cheol Kim, Changwon-si (KR)

( * ) Notice: Subject to any disclaimer, the term of this patent is extended or adjusted under 35 U.S.C. 154(b) by 184 days.

(21) Appl. No.: 16/548,954

(22) Filed: Aug. 23, 2019

(65) Prior Publication Data

US 2020/0063965 A1 Feb. 27, 2020

(30) Foreign Application Priority Data

Aug. 23, 2018 (KR) ..... 10-2018-0098671

(51) Int. Cl.
*F23R 3/00* (2006.01)
*F23R 3/28* (2006.01)

(52) U.S. Cl.
CPC ..... *F23R 3/286* (2013.01)

(58) Field of Classification Search
CPC .... F23R 3/286; F23R 3/04; F23R 3/06; F23R 3/10; F23R 3/12; F23R 3/14; F23R 3/16; F23R 3/28; F23R 3/283; F23R 3/32; F23R 3/46; F02C 7/22; F02C 7/222
See application file for complete search history.

(56) References Cited

U.S. PATENT DOCUMENTS 2,676,461 A * 4/1954 Gove ..... F02C 7/228 60/739
3,774,851 A * 11/1973 Simmons ..... F16K 15/042 239/551
5,251,447 A * 10/1993 Joshi ..... F23R 3/14 239/403
2012/0324896 A1* 12/2012 Kim ..... F23C 7/004 60/737
2013/0122434 A1* 5/2013 Stoia ..... F23R 3/286 431/12
2014/0174089 A1 6/2014 Melton et al.
2014/0338354 A1* 11/2014 Stewart ..... F23R 3/286 60/776

FOREIGN PATENT DOCUMENTS

JP 2013190200 A 9/2013

OTHER PUBLICATIONS

A Korean Office Action dated Sep. 2, 2019 in connection with Korean Patent Application No. 10-2018-0098671 which corresponds to the above-referenced U.S. application.

* cited by examiner

*Primary Examiner* — Edwin Kang
(74) *Attorney, Agent, or Firm* — Harvest IP Law, LLP

(57) ABSTRACT

A gas turbine combustor includes a combustion chamber coupled to a nozzle unit that is radially partitioned into plural regions. Each region includes a nozzle casing; a nozzle supplied with fuel and air to produce a mixed gas of the fuel and the air and configured to be inserted into the nozzle casing and to inject the mixed gas into the combustion chamber; a fuel supply section coupled to an outer peripheral surface of the nozzle casing to supply the fuel to the nozzle through the outer peripheral surface; a fuel plenum formed in the nozzle casing to receive the fuel from the fuel supply section; and an air plenum formed in the nozzle casing toward the combustion chamber to receive a portion of the air supplied to the nozzle unit, the portion of air introduced to the air plenum through a first opening formed in the nozzle casing.

15 Claims, 32 Drawing Sheets

[FIG. 1]
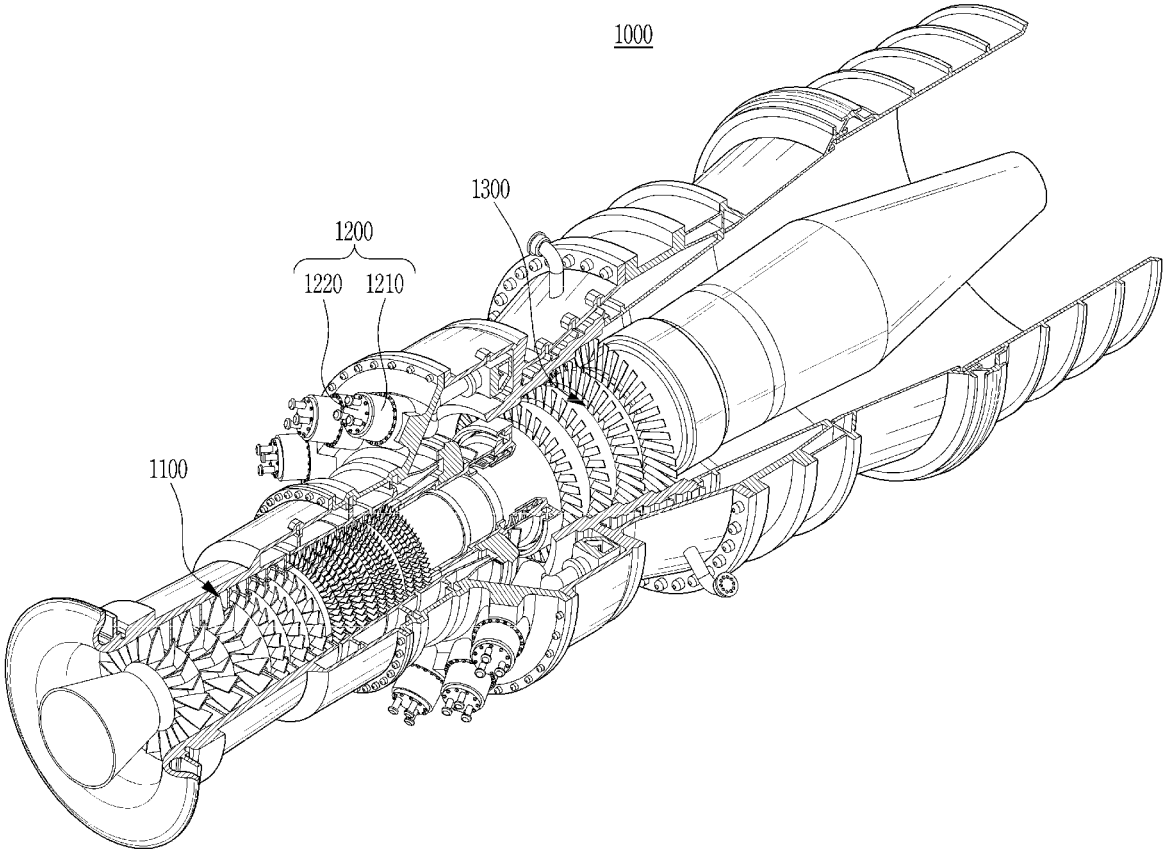

[FIG. 2]
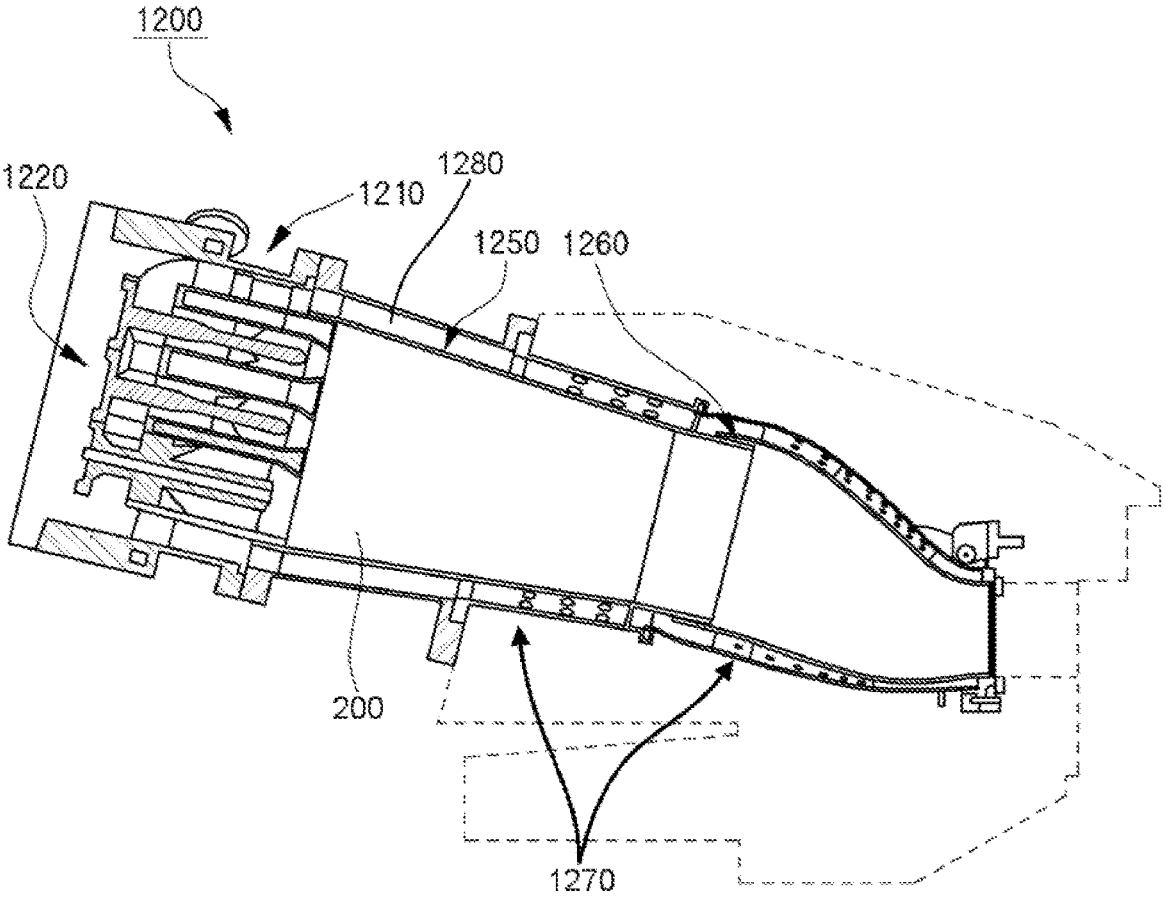

[FIG. 3]
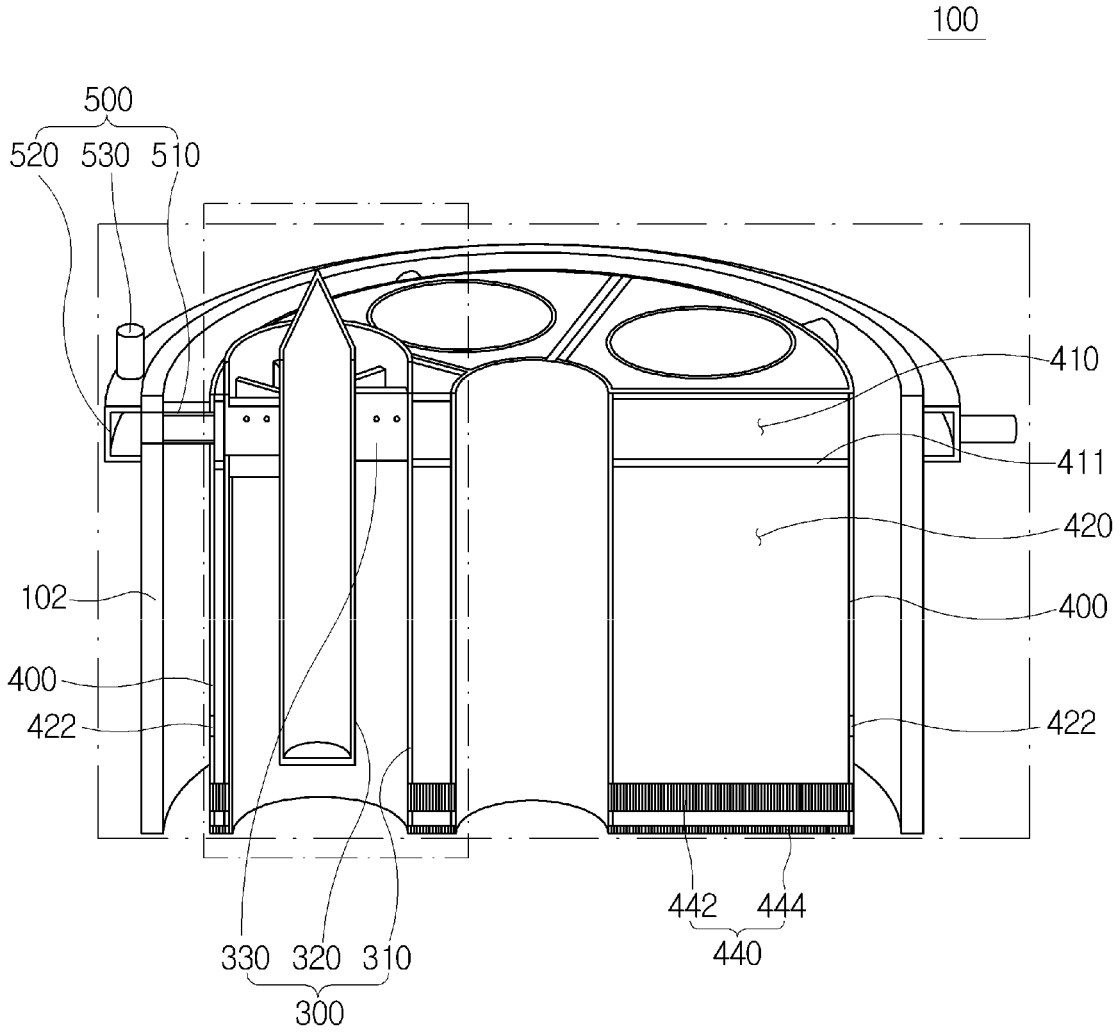

[FIG. 4]
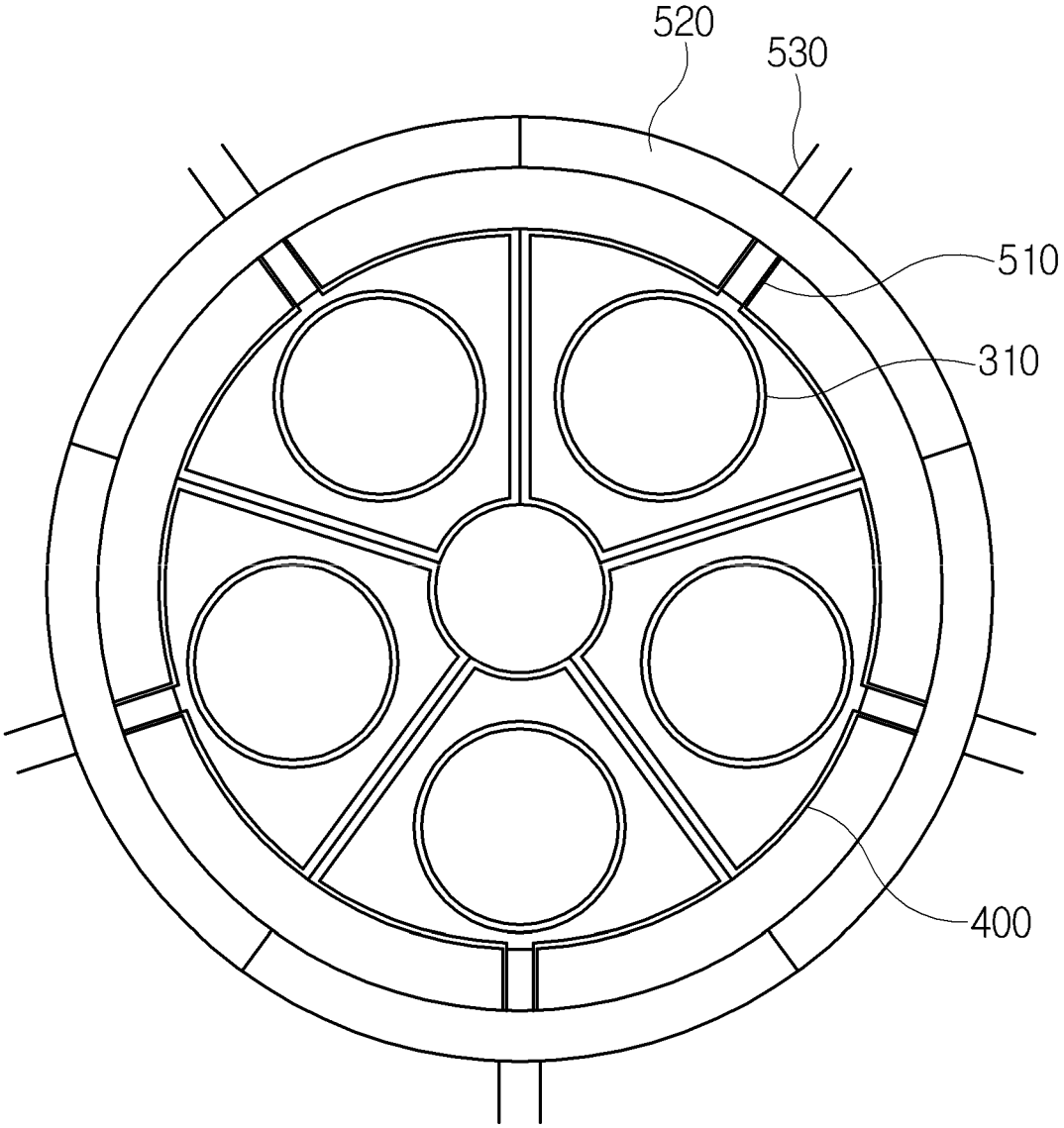

[FIG. 5]
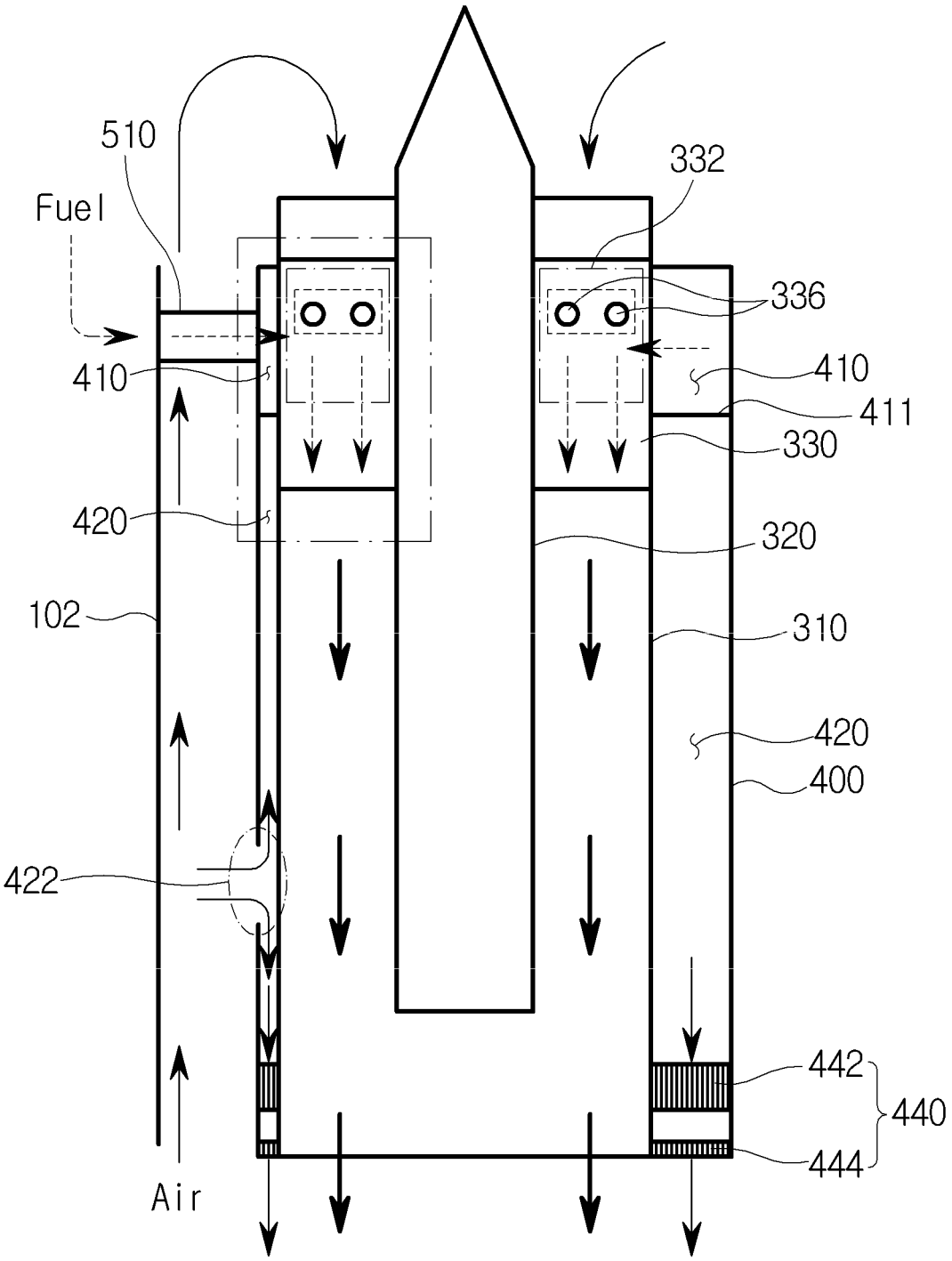

[FIG. 6]
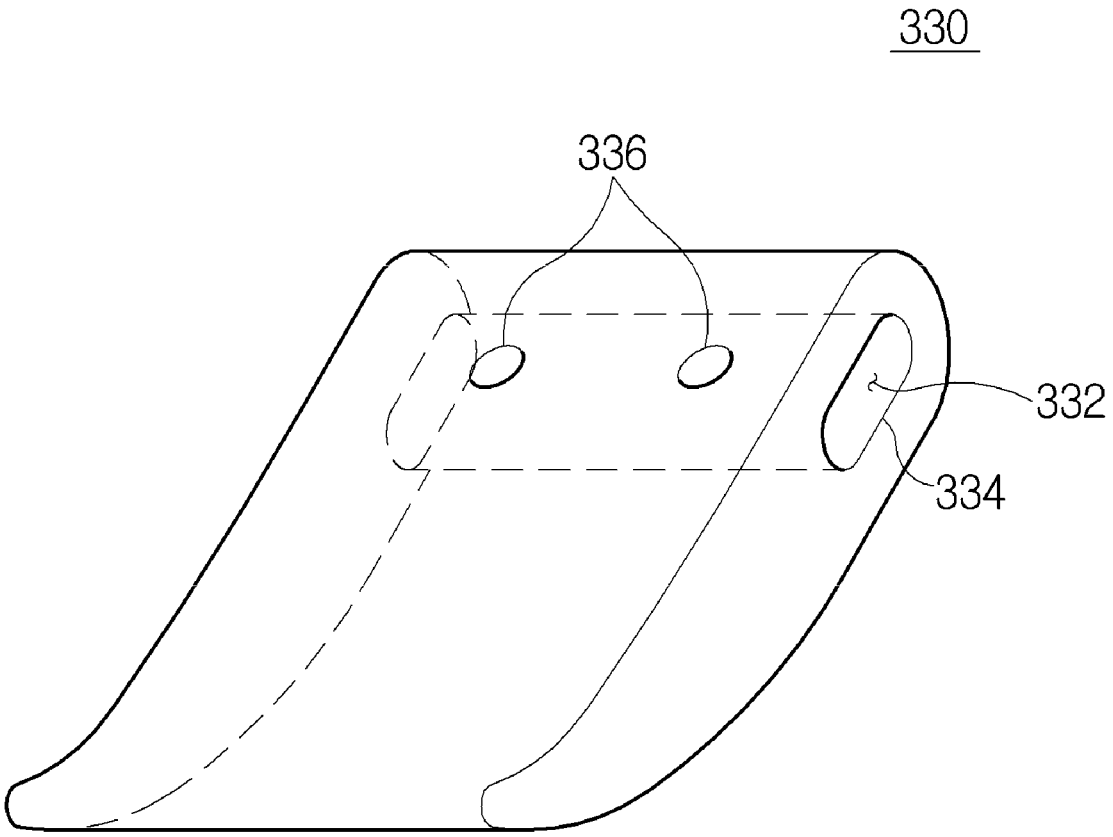

[FIG. 7]
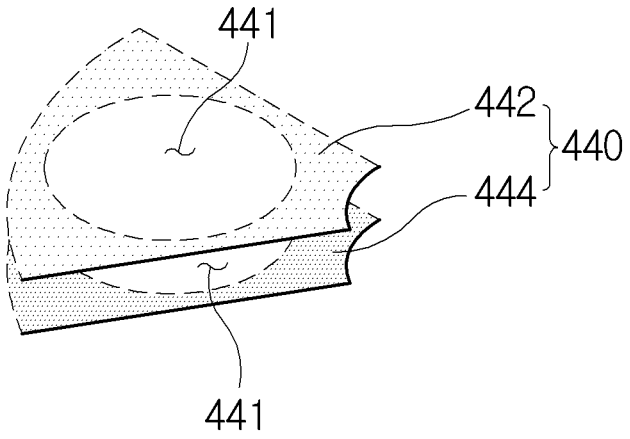

[FIG. 8A]
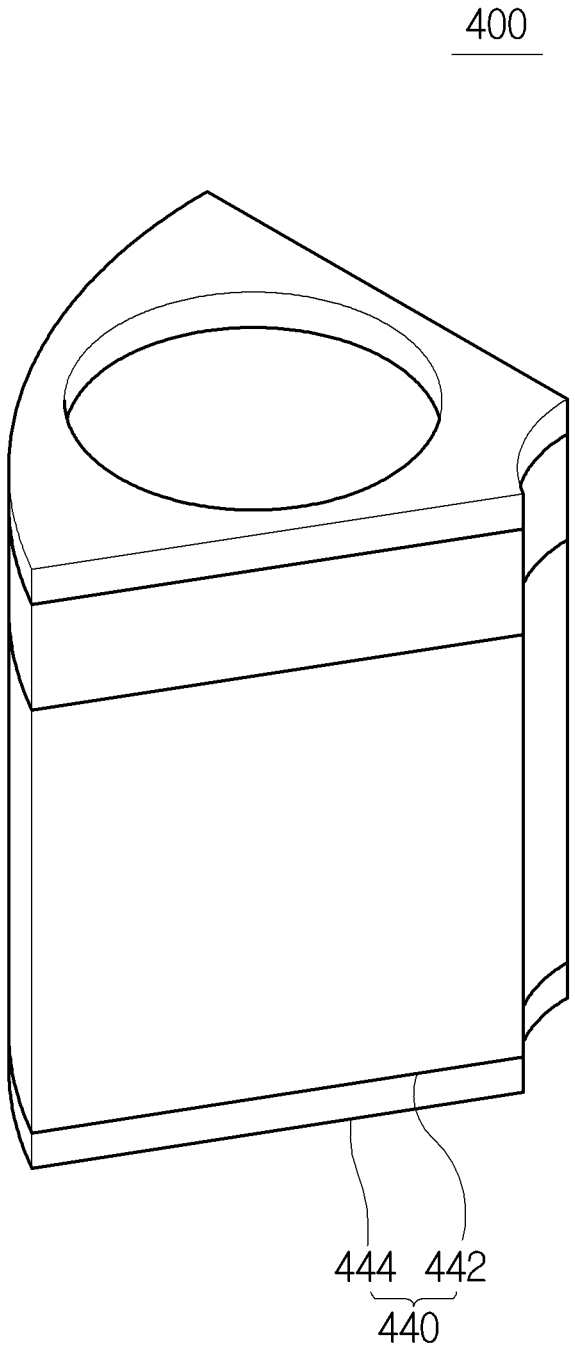

[FIG. 8B]
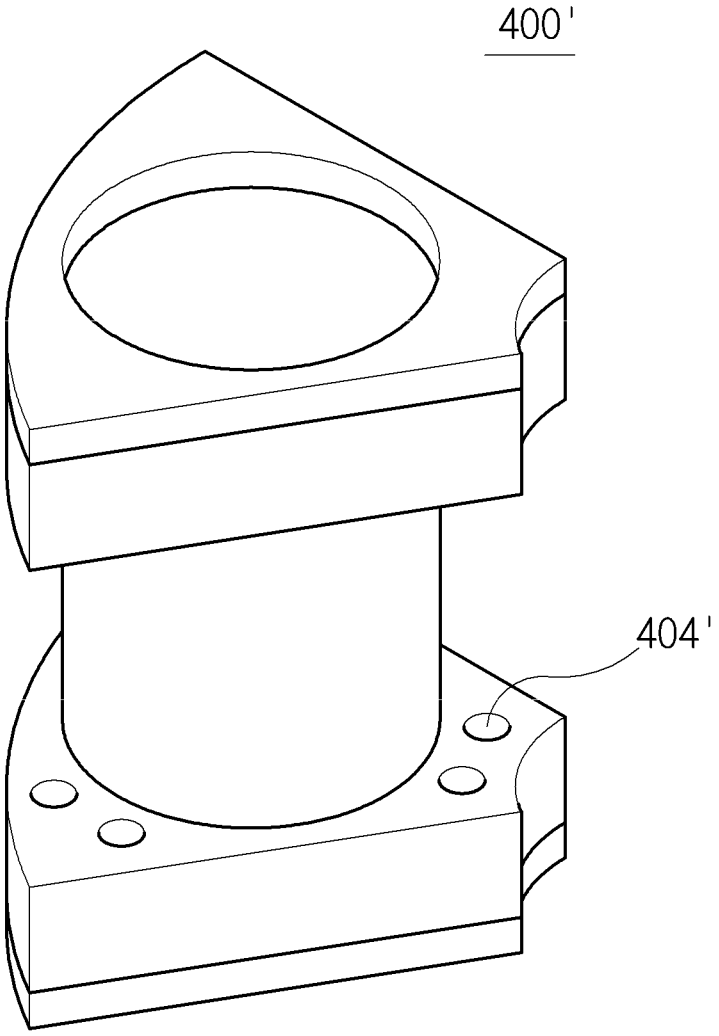

[FIG. 8C]
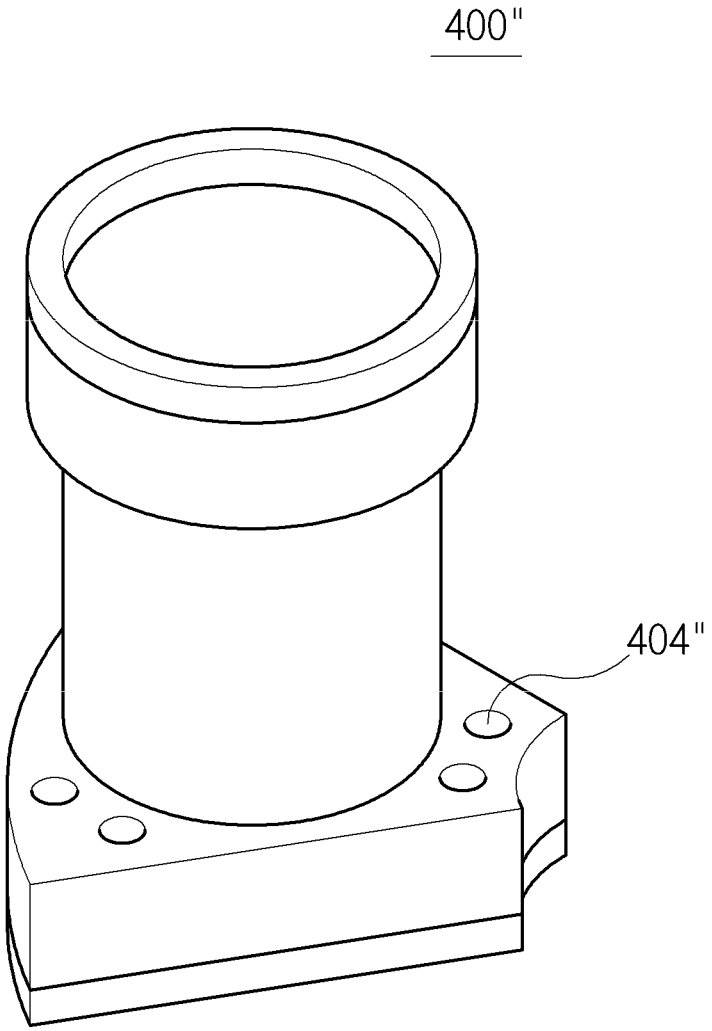

[FIG. 9A]
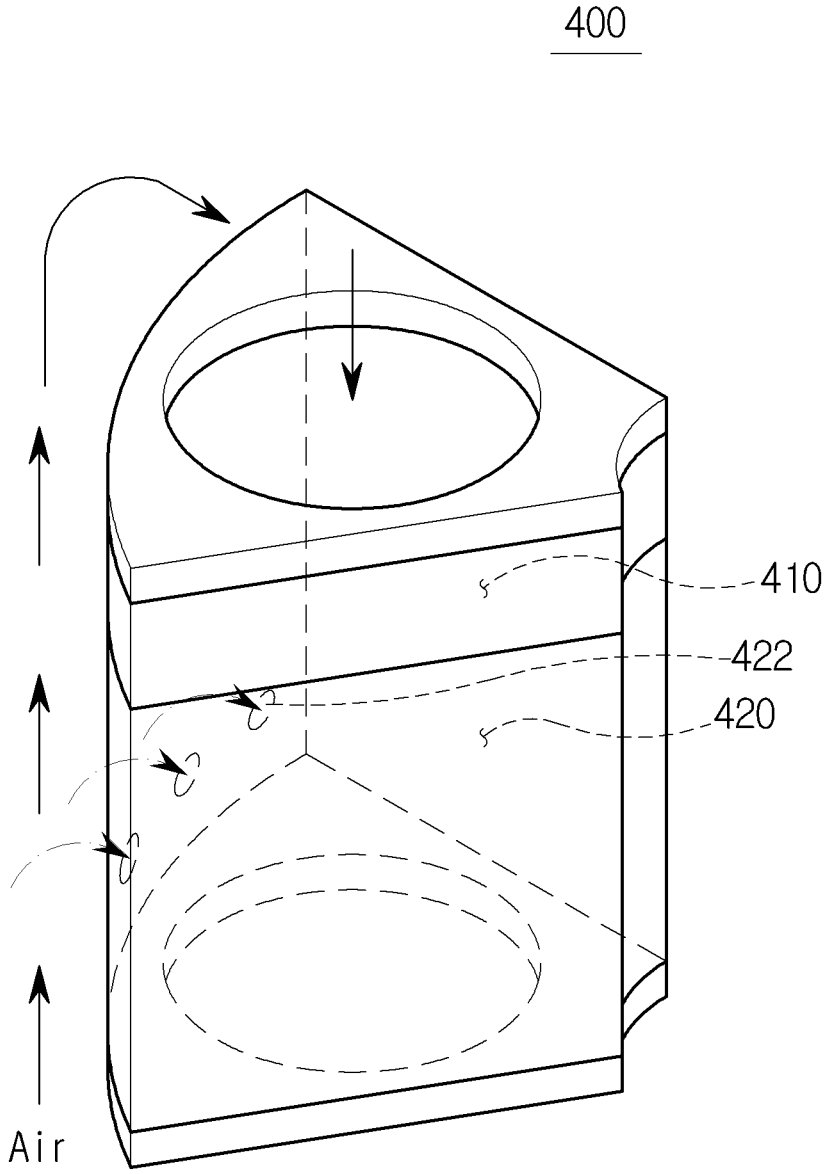

[FIG. 9B]
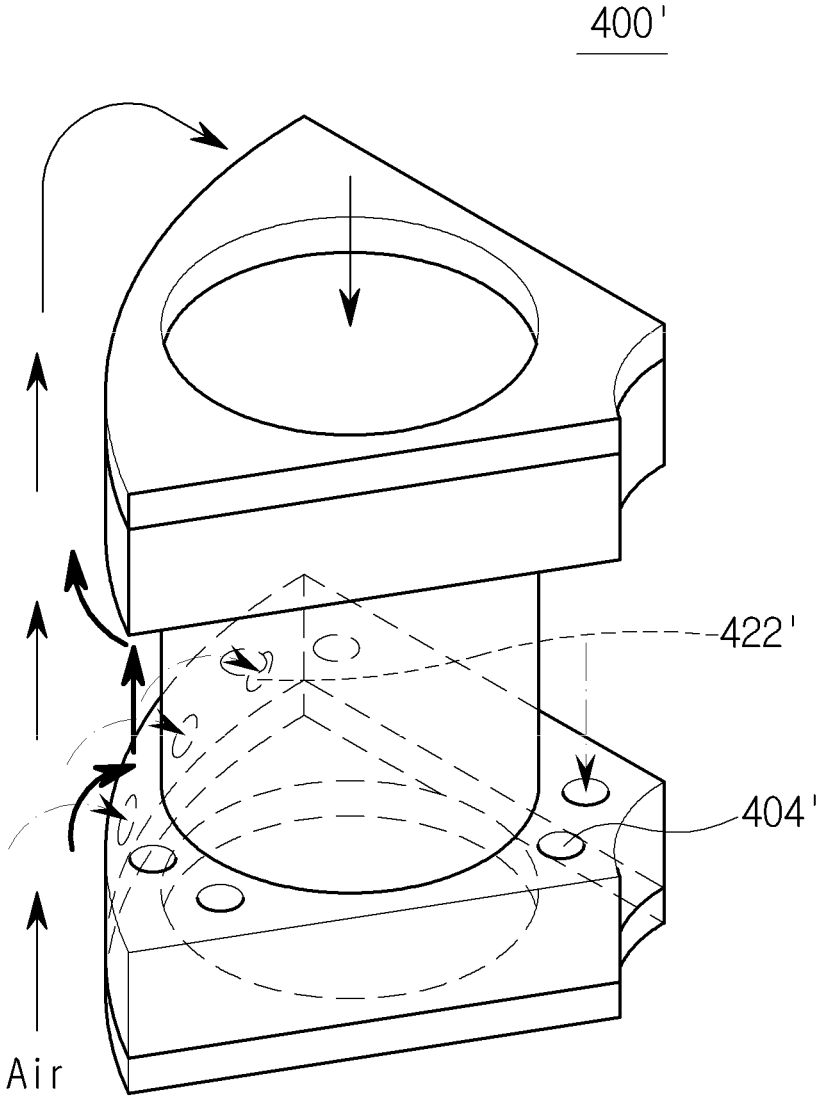

[FIG. 9C]
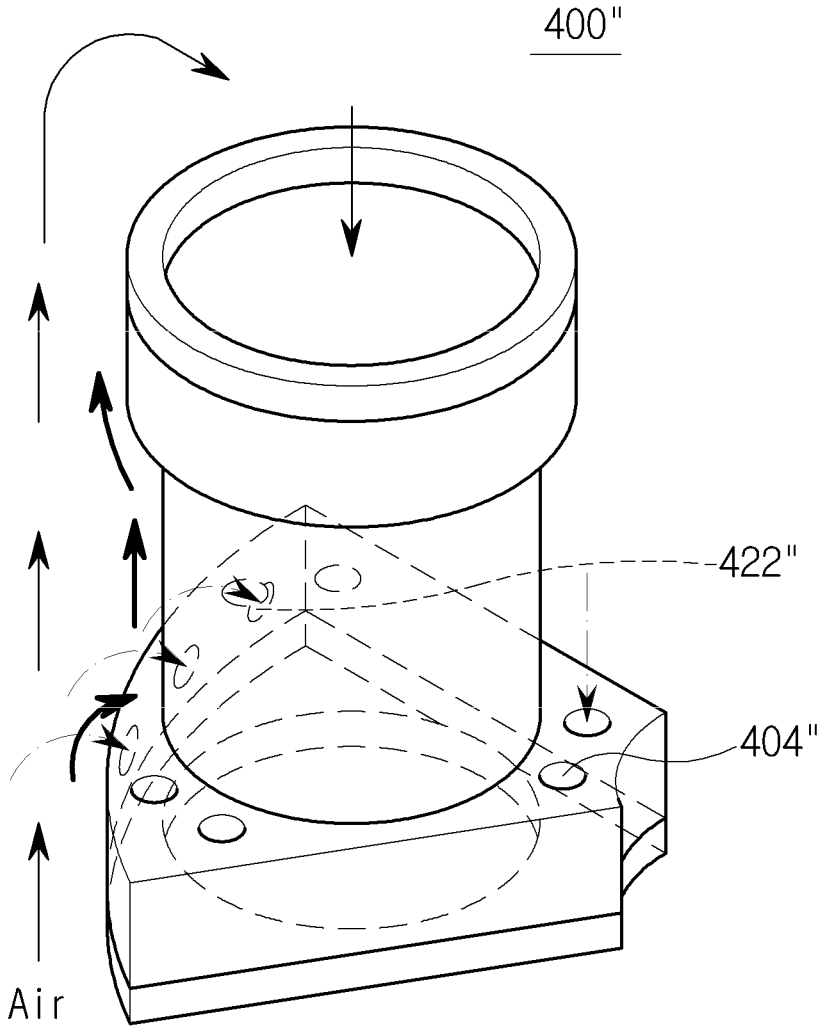

[FIG. 10A]
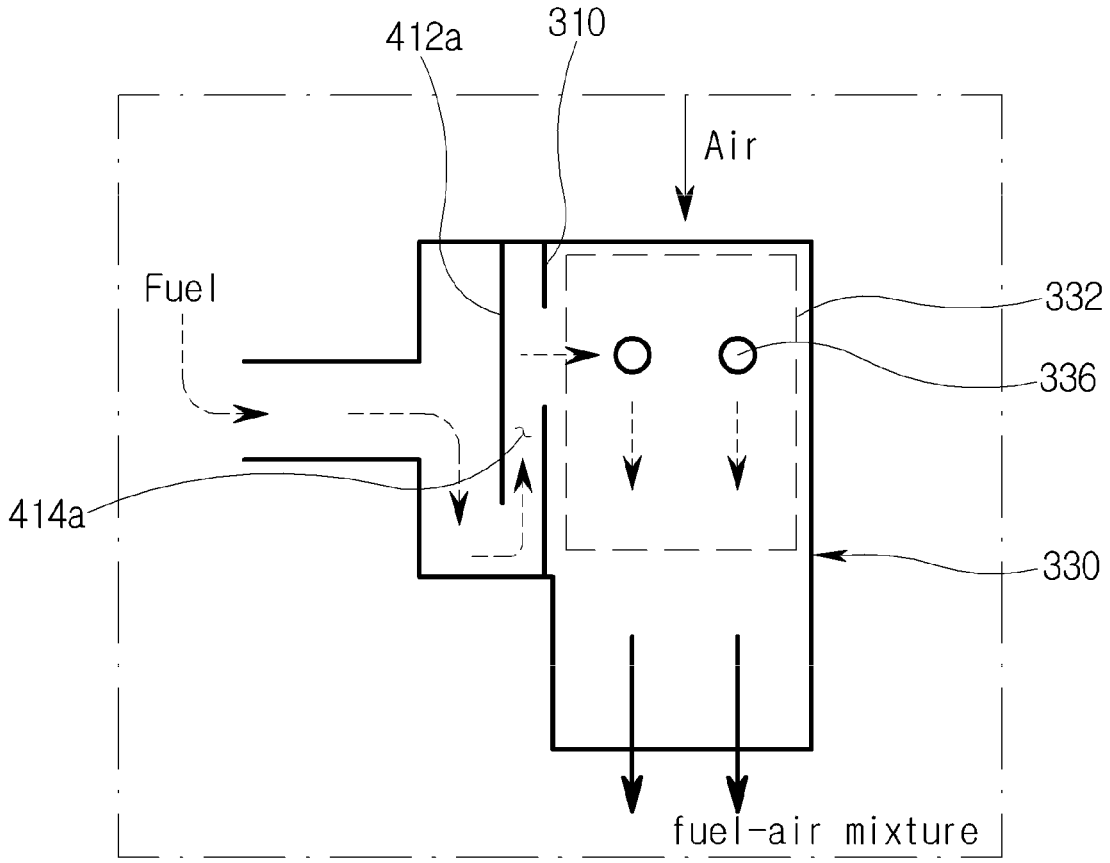

[FIG. 10B]
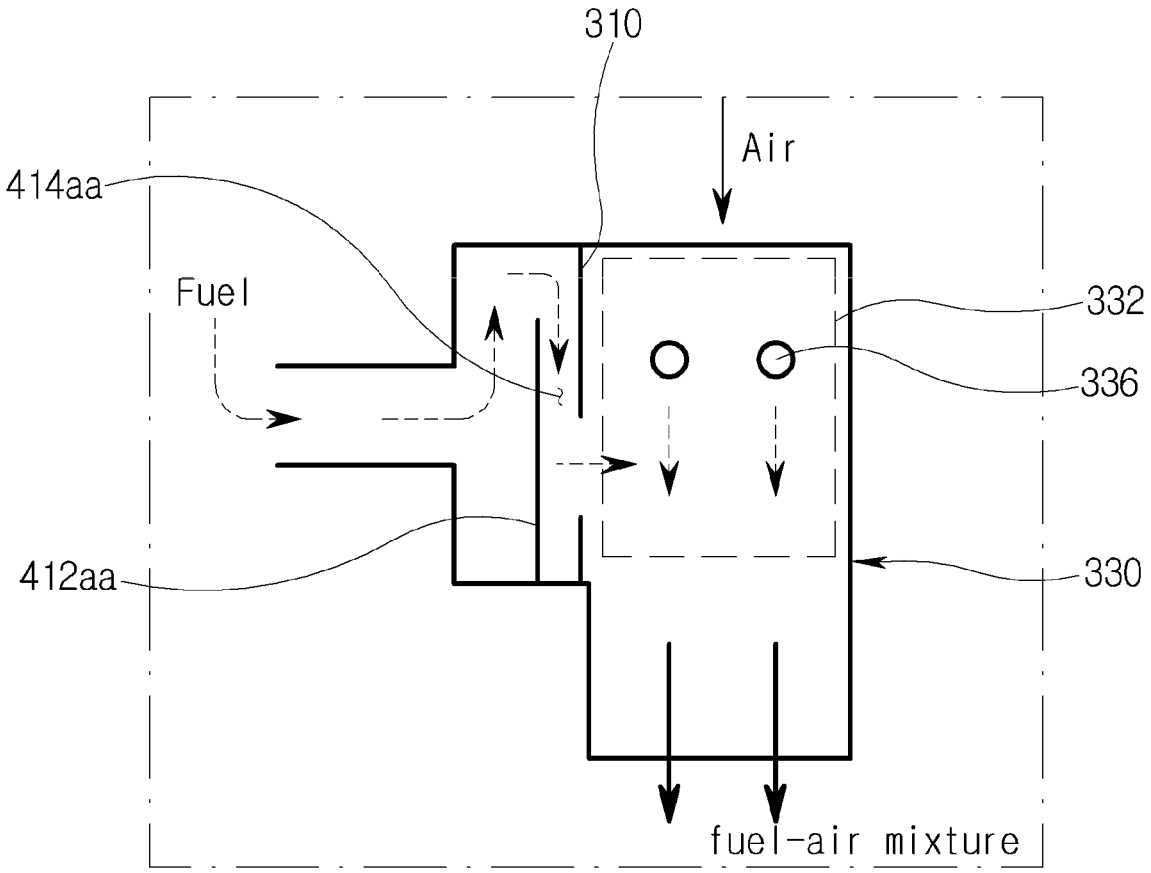

[FIG. 10C]
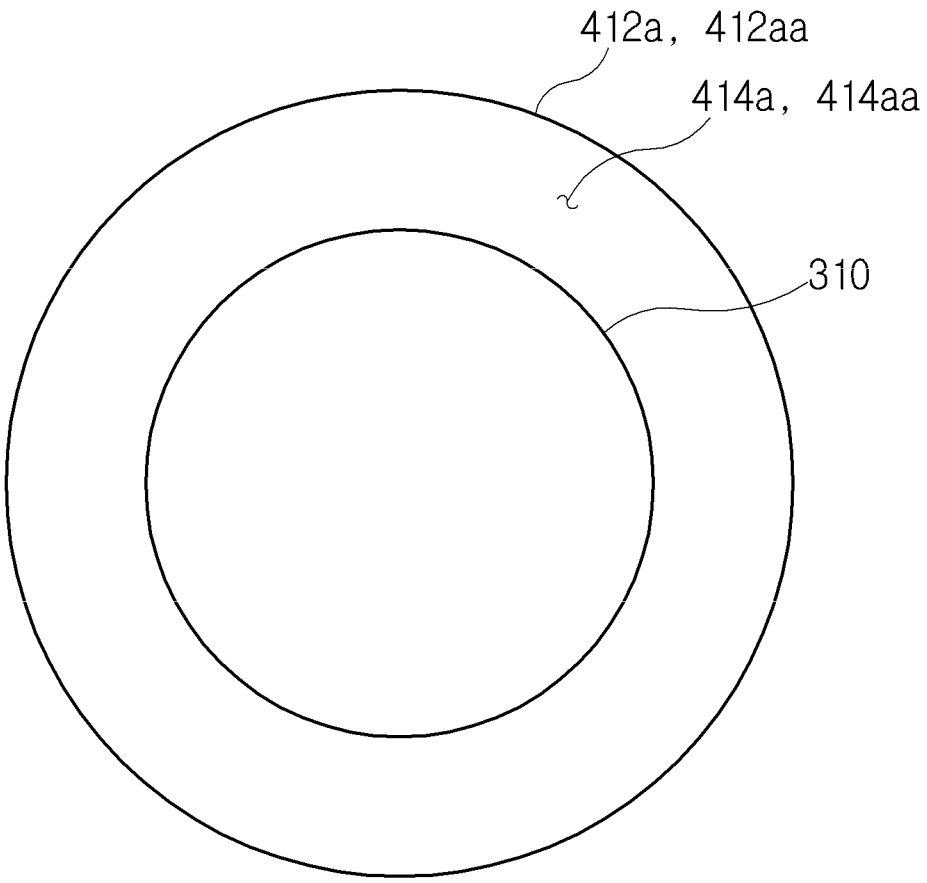

[FIG. 11A]
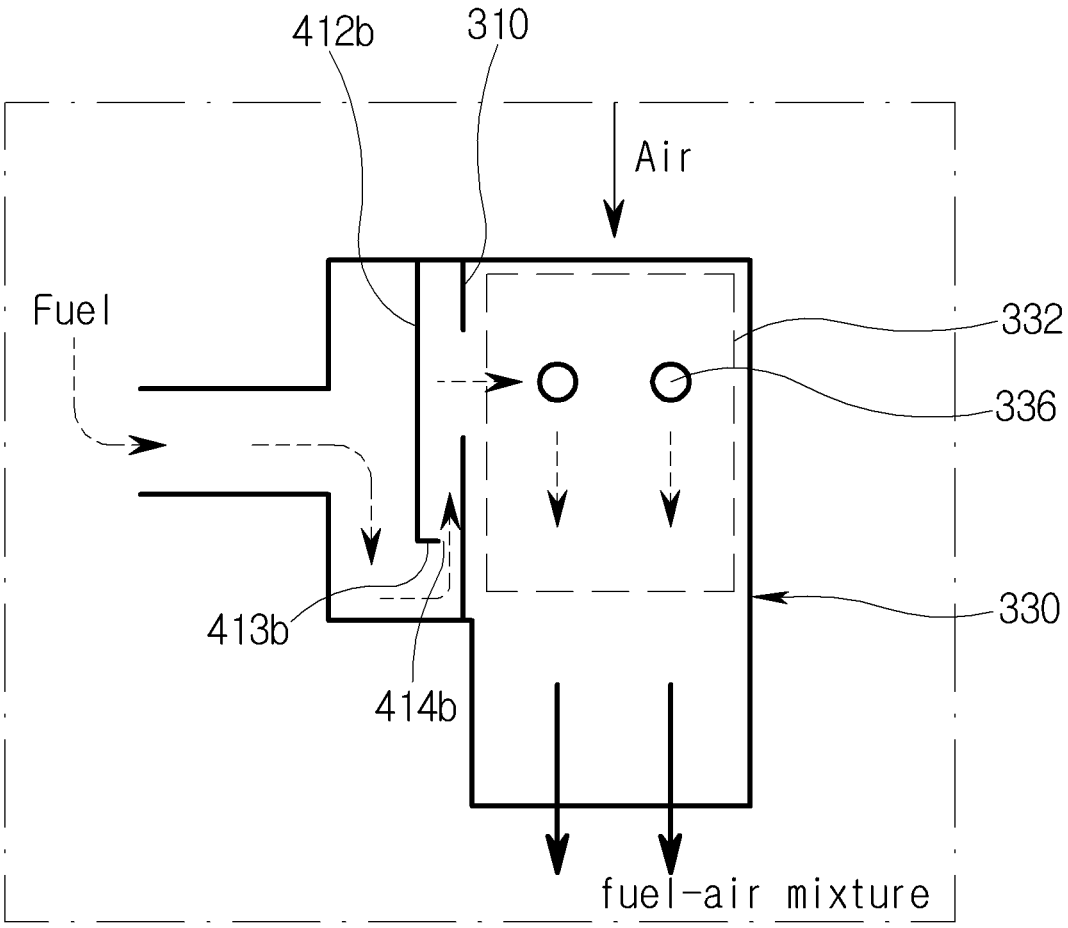

[FIG. 11B]
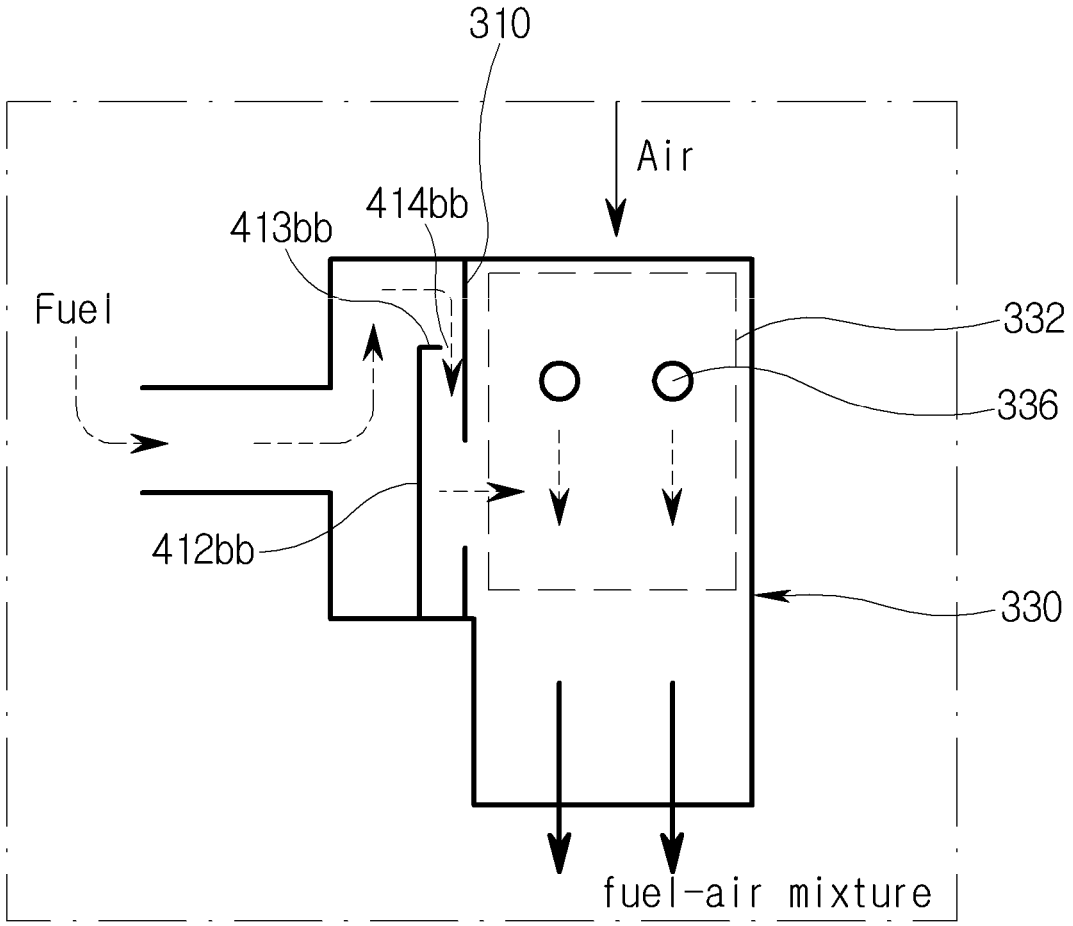

[FIG. 11C]
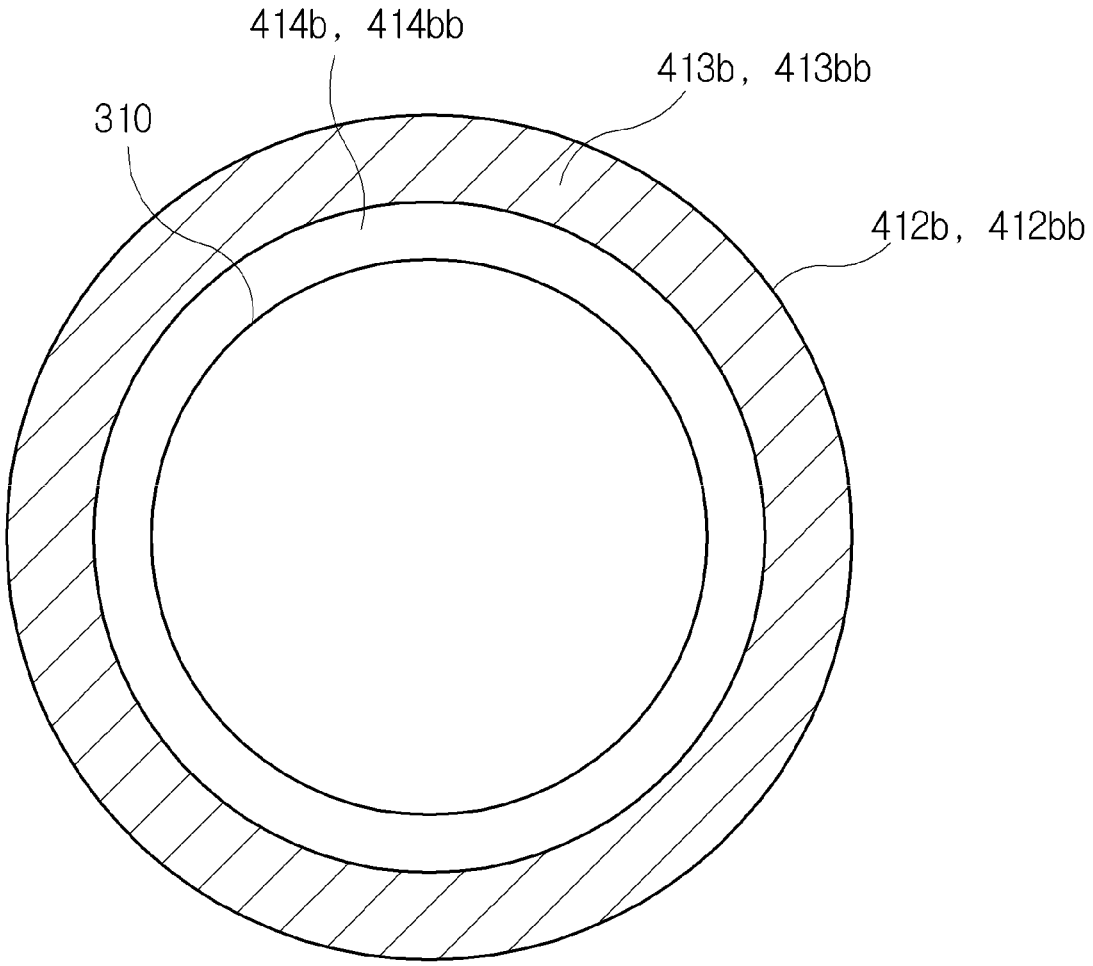

[FIG. 11D]
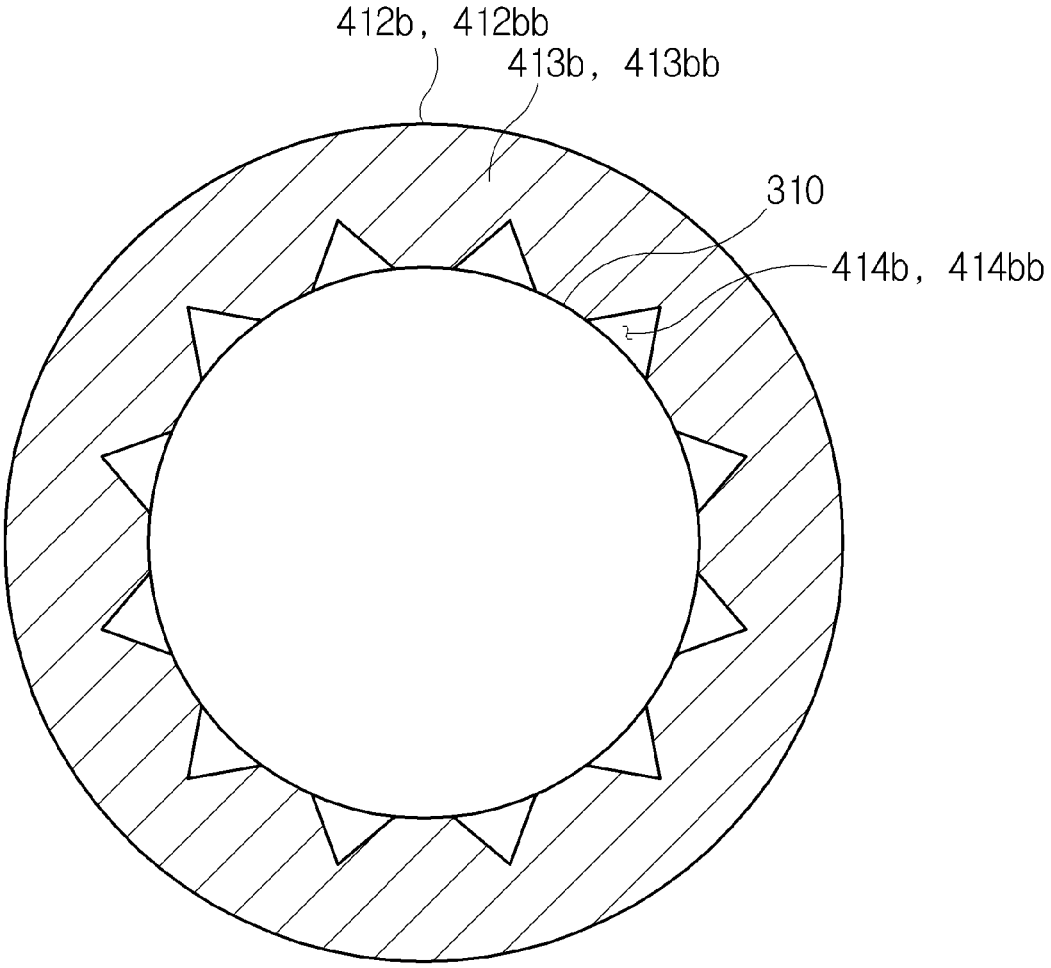

[FIG. 11E]
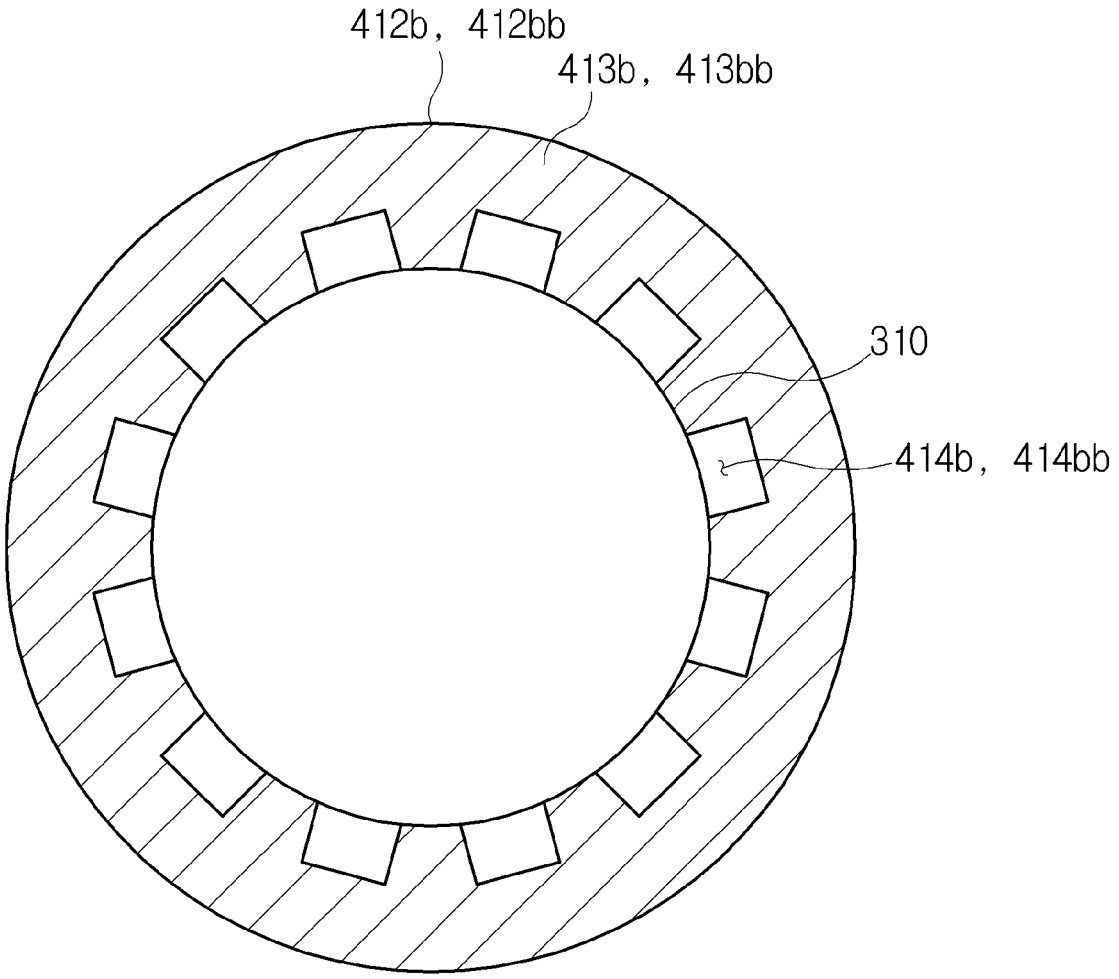

[FIG. 11F]
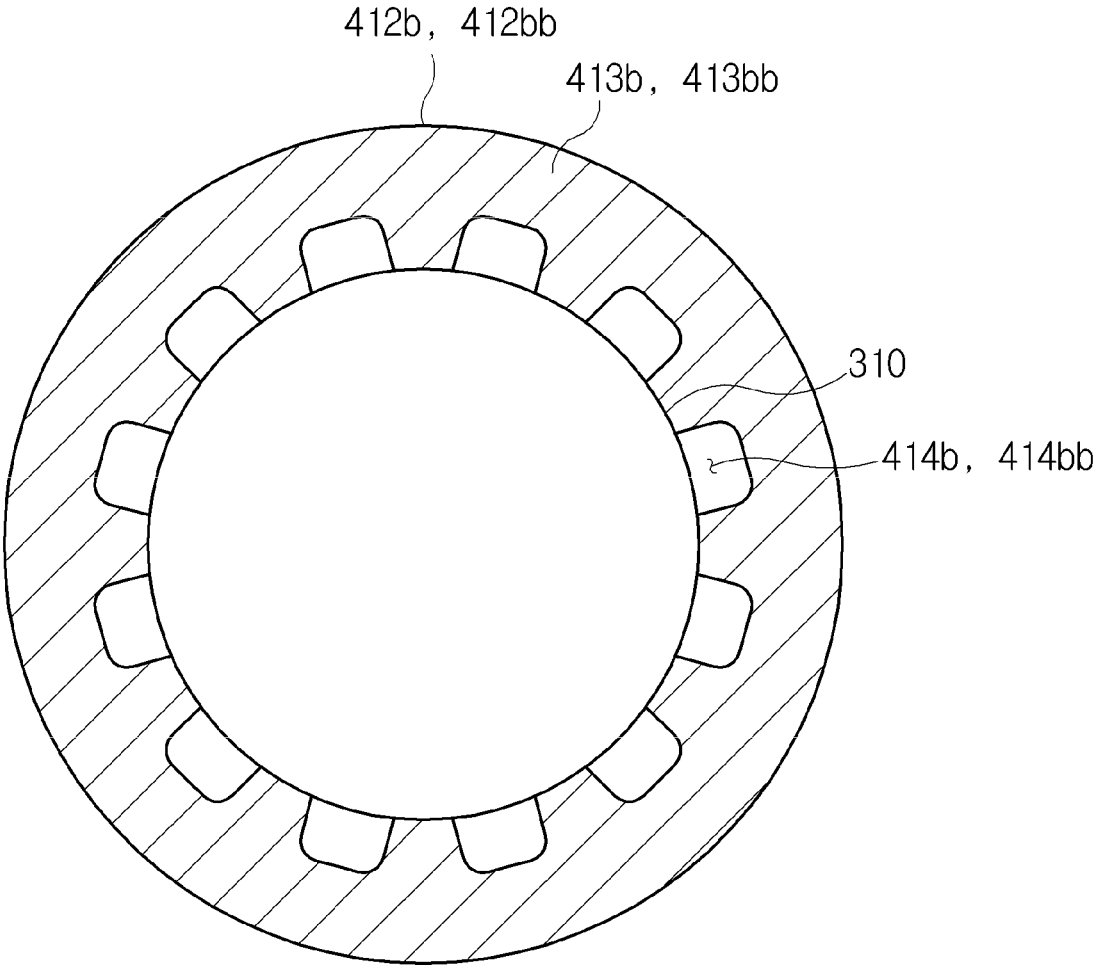

[FIG. 11G]
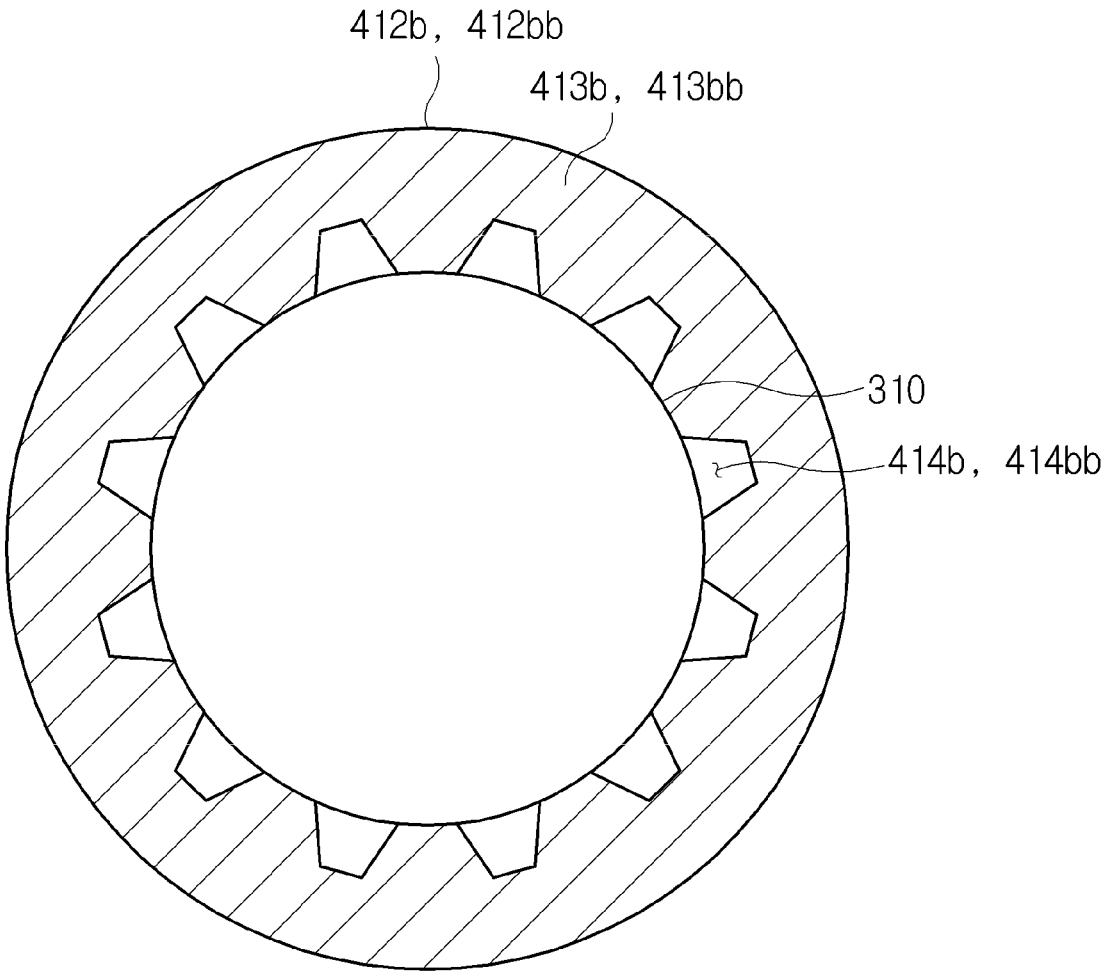

[FIG. 11H]
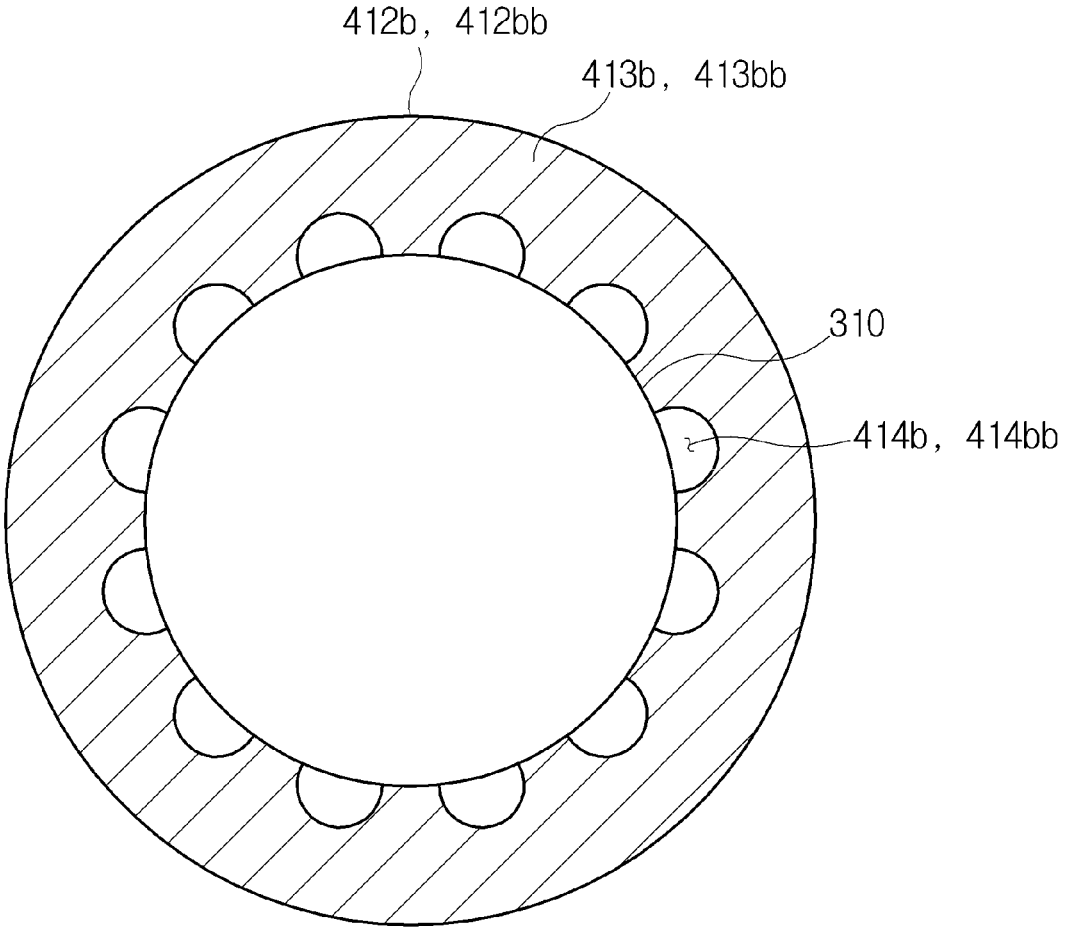

[FIG. 12A]
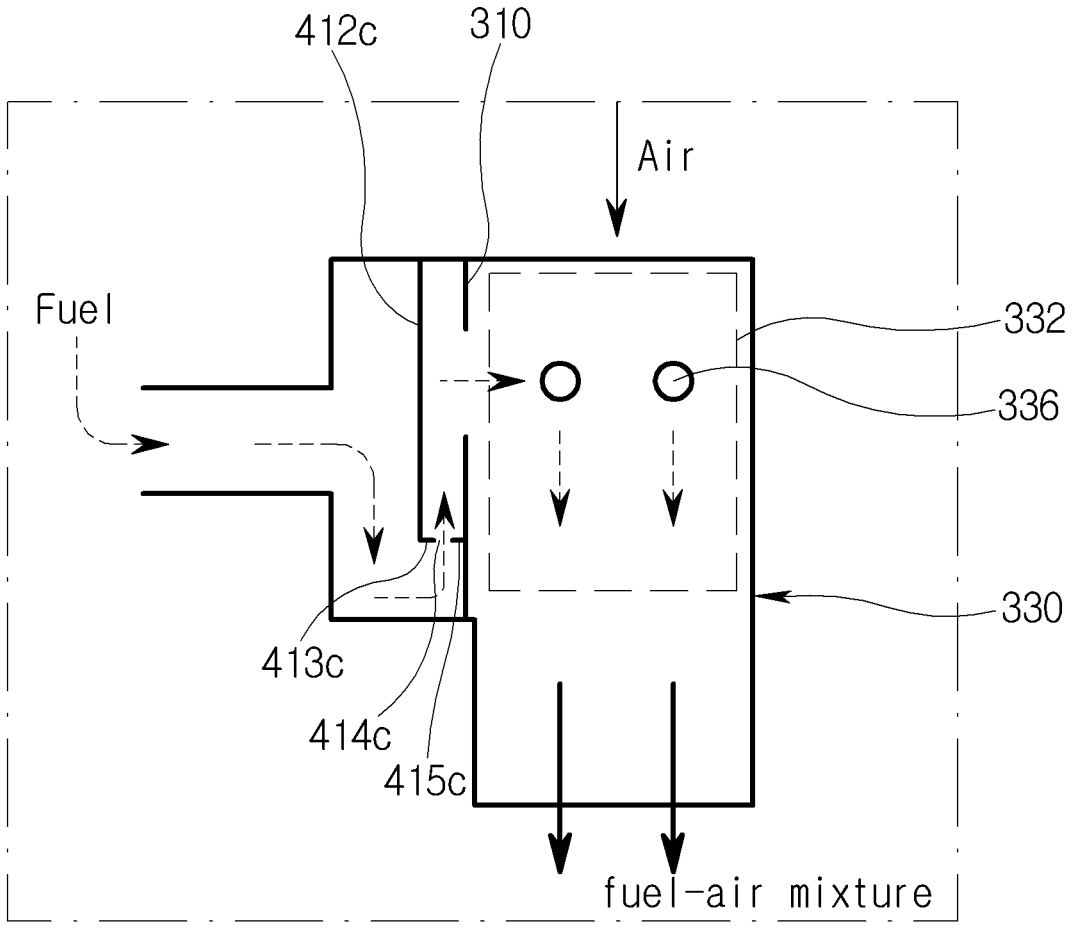

[FIG. 12B]
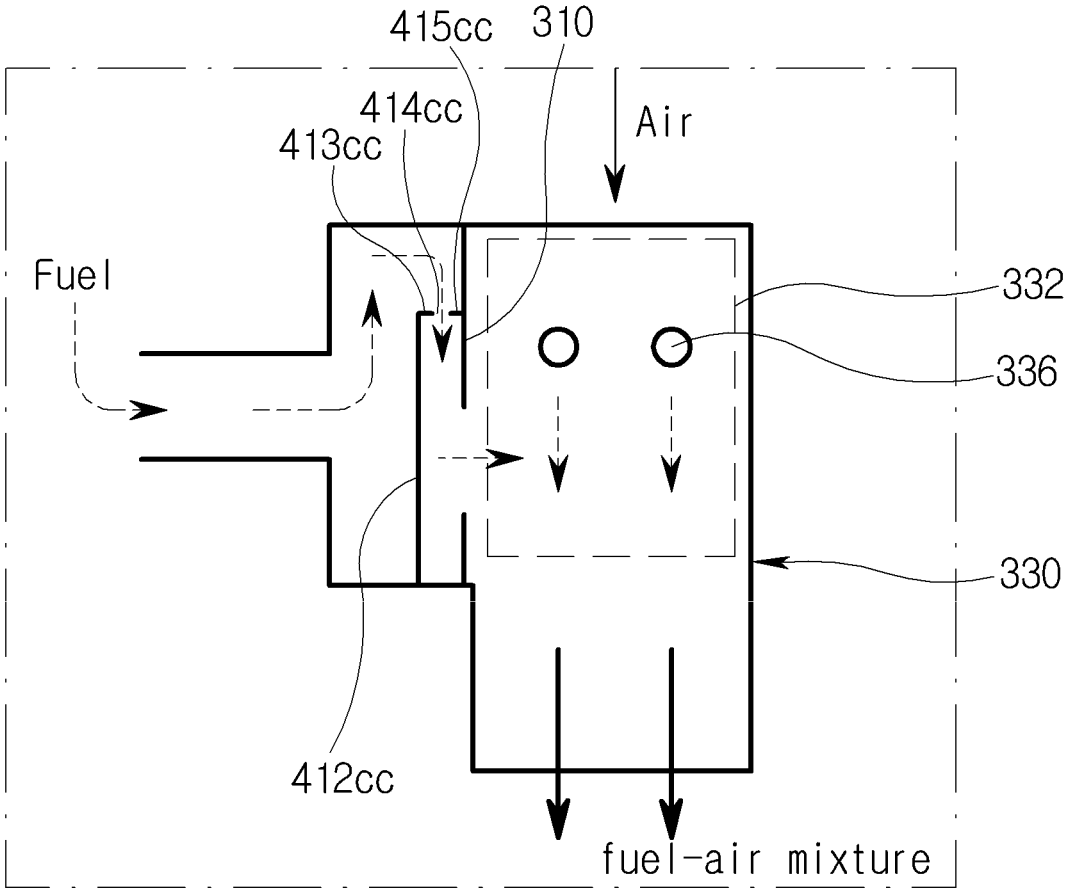

[FIG. 12C]
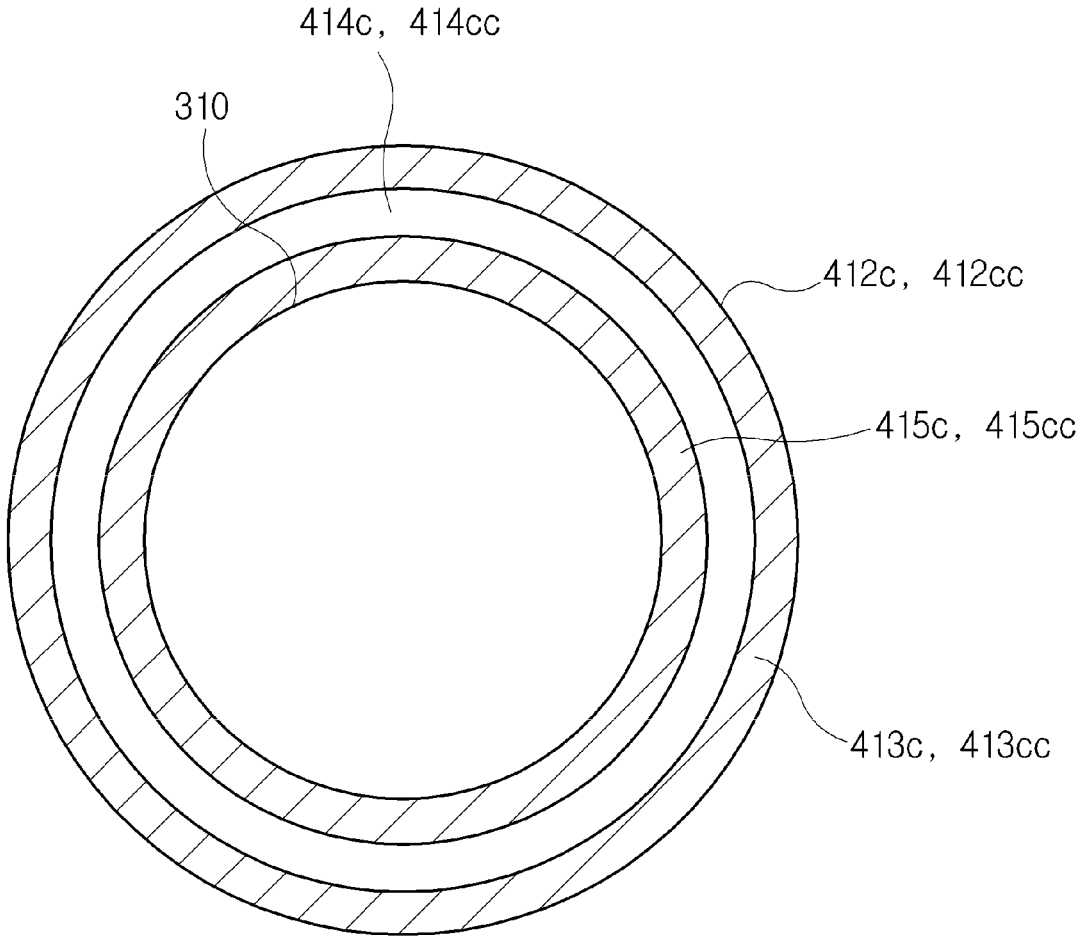

[FIG. 12D]
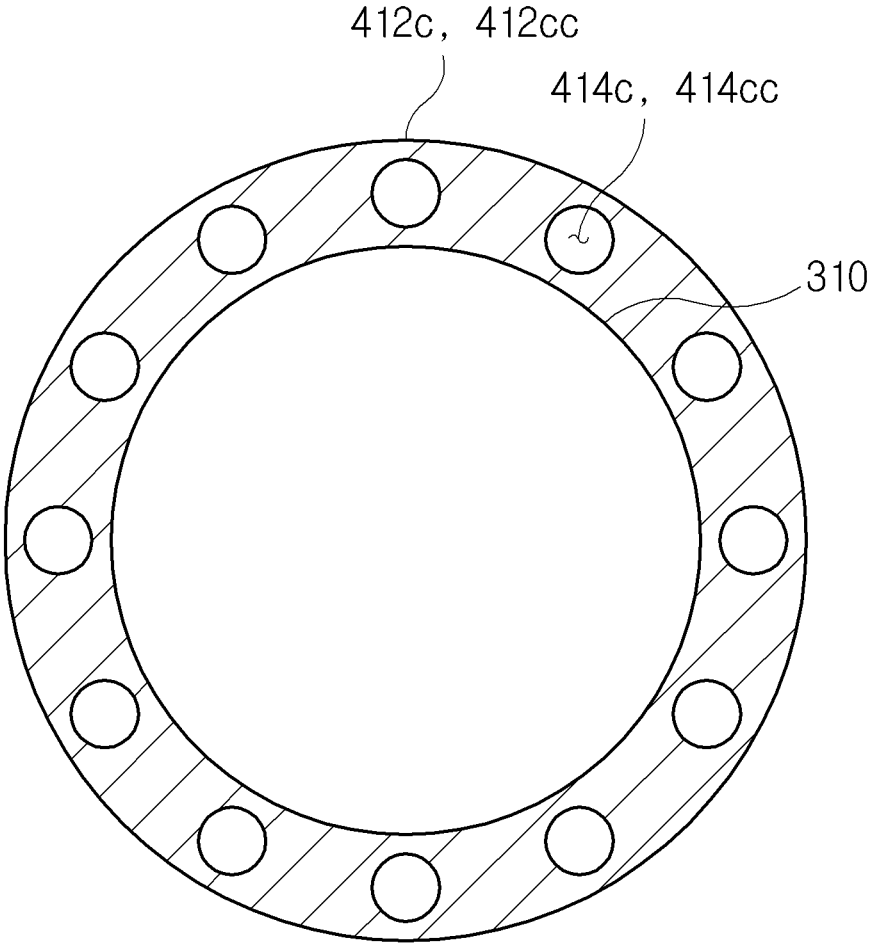

[FIG. 12E]
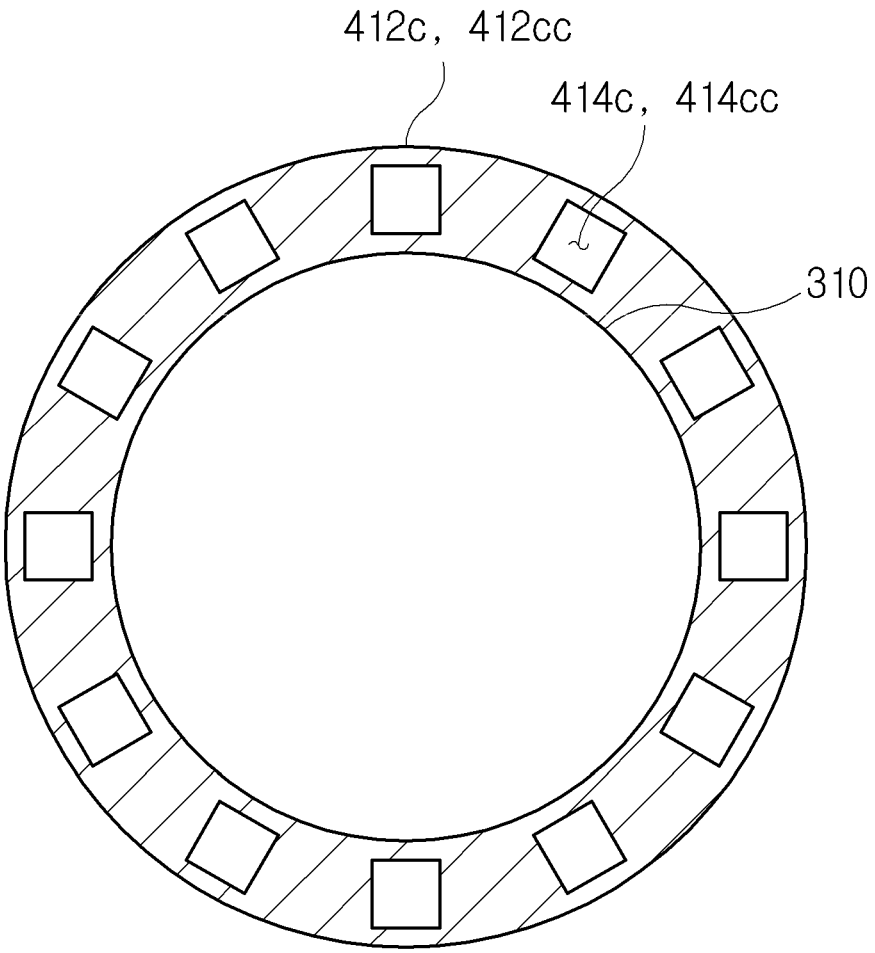

[FIG. 12F]
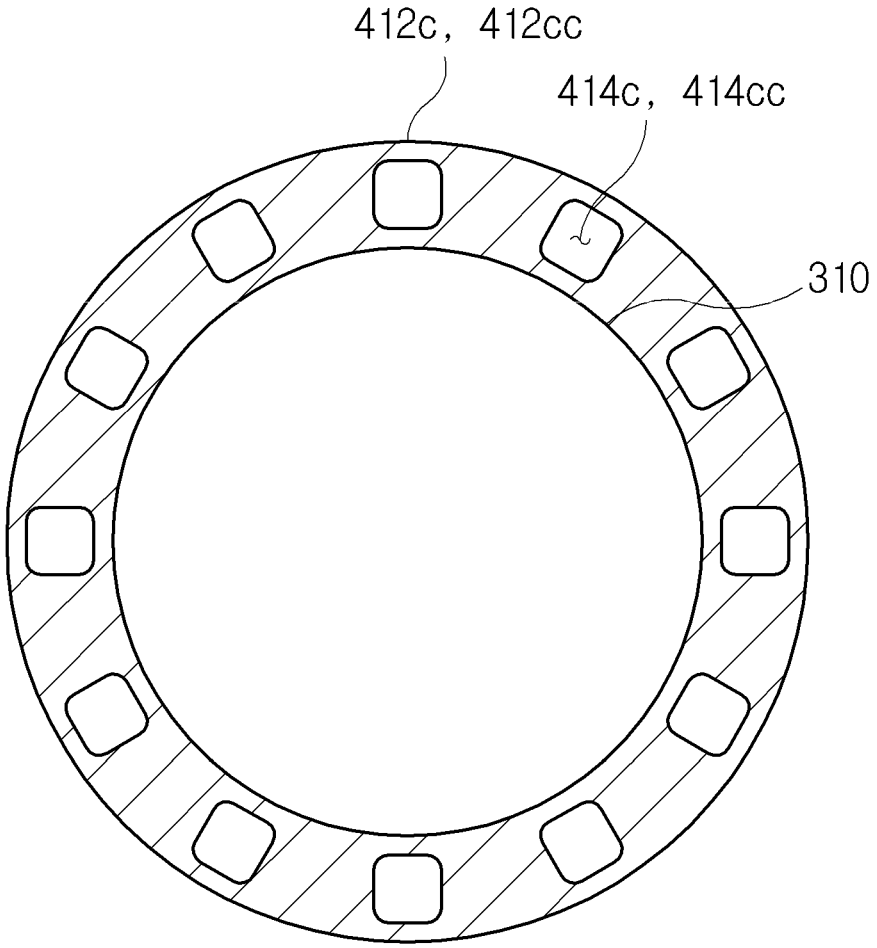

[FIG. 12G]
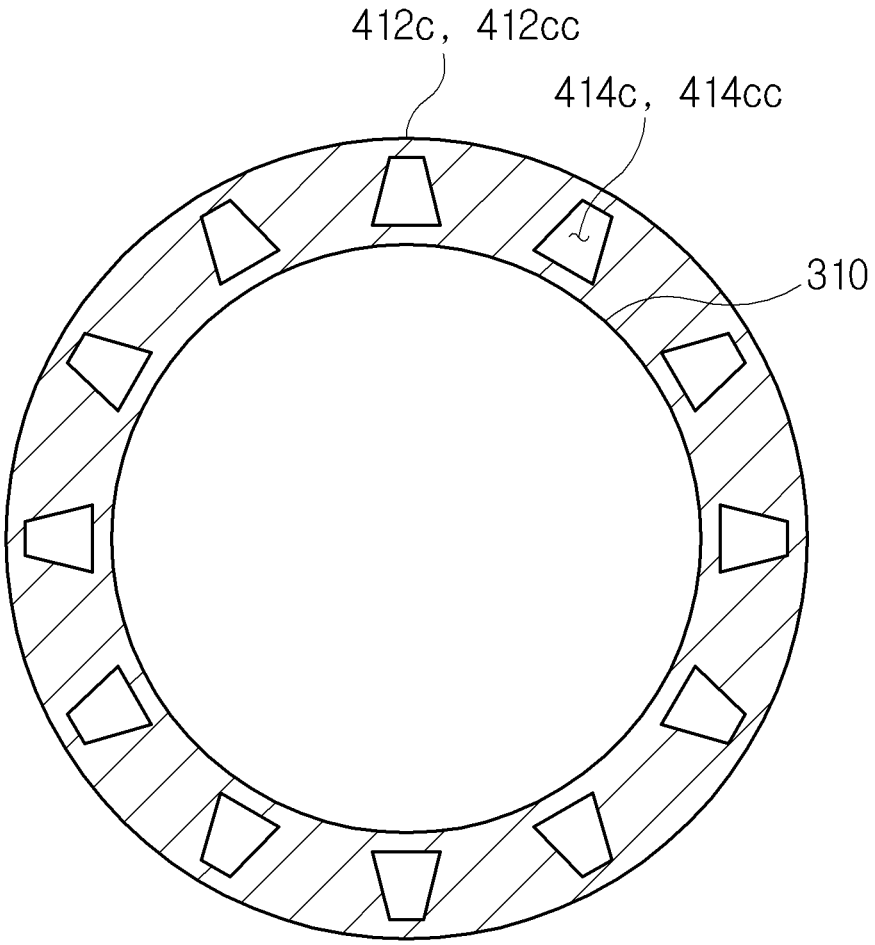

[FIG. 12H]
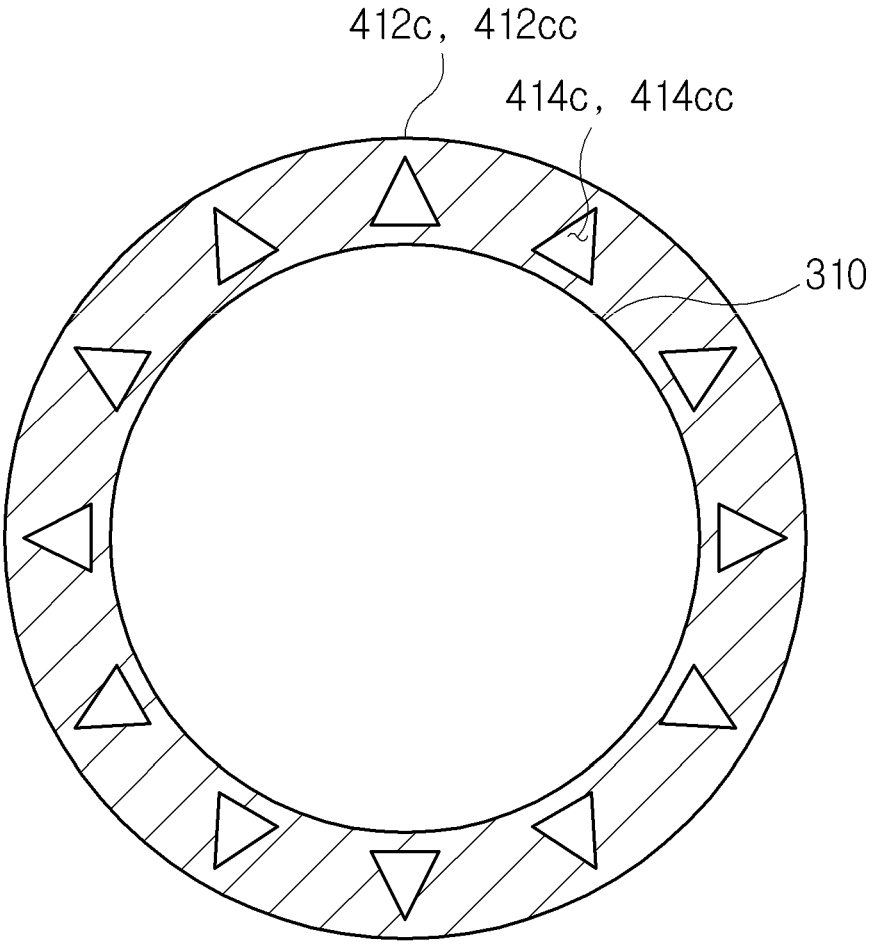

GAS TURBINE COMBUSTOR

CROSS-REFERENCE TO RELATED APPLICATIONS

This application claims priority to Korean Patent Application No. 10-2018-0098671, filed on Aug. 23, 2018, the disclosure of which is incorporated herein by reference in its entirety.

BACKGROUND OF THE DISCLOSURE

Field of the Disclosure

Exemplary embodiments of the present disclosure relate to a gas turbine combustor, and more particularly, to a nozzle structure and a path of fuel and air supplied to a nozzle.

Description of the Related Art

In general, a turbine is a machine that converts the energy of a flowing fluid such as water, gas, or steam into mechanical work. A turbine may be referred to as a turbomachine and typically includes many buckets or blades mounted to the circumference of a rotating body, which is rotated at high speed by an impulsive or reaction force caused by the fluid flowing between the buckets/blades.

Examples of the turbine include a water turbine using the energy of elevated water, a steam turbine using the energy of steam, an air turbine using the energy of high-pressure compressed air, and a gas turbine using the energy of high-temperature and high-pressure gas. Among these, the gas turbine includes a compressor, a combustor, and a turbine.

The compressor of a gas turbine includes a plurality of compressor vanes and compressor blades arranged alternately and compresses air to send it to the combustor. The combustor mixes the compressed air with a supply of fuel and ignites the mixture, thereby producing high-temperature and high-pressure combustion gas, which is discharged into the turbine. The turbine includes an alternating arrangement of a plurality of turbine vanes and a plurality of turbine blades, and the discharged combustion gas generates rotational force while passing through the turbine blades.

In a large gas turbine, the combustor may consist of a plurality of combustors arranged annularly around the axis of the gas turbine. Meanwhile, each combustor includes a plurality of nozzles for injecting fuel into a combustion chamber coupled to the nozzles. The nozzles may include peripheral nozzles surrounding a main nozzle formed at the center of the combustor, in which case fuel is supplied from an axial center of the arrangement of the peripheral nozzles.

However, such a conventional gas turbine combustor is problematic in that the path of the fuel supplied to the nozzles is complicated and the fuel is not uniformly distributed.

SUMMARY OF THE DISCLOSURE

Accordingly, it is an object of the present disclosure to provide a gas turbine combustor in which each nozzle is easily assembled and disassembled and in which fuel supplied to a plurality of nozzles can be uniformly distributed.

In addition, it is another object of the present disclosure to provide a gas turbine combustor in which compressed air introduced into a combustor nozzle can be uniformly distributed by changing a fuel supply path.

Other objects and advantages of the present disclosure can be understood by the following description, and become apparent with reference to the embodiments of the present disclosure. Also, it is obvious to those skilled in the art to which the present disclosure pertains that the objects and advantages of the present disclosure can be realized by the means as claimed and combinations thereof.

In accordance with one aspect of the present disclosure, there is provided a gas turbine combustor including a combustion chamber coupled to a nozzle unit that is radially partitioned into a plurality of regions. Each region of the nozzle unit may include a nozzle casing; a nozzle supplied with fuel and air to produce a mixed gas of the fuel and the air and configured to be inserted into the nozzle casing and to inject the mixed gas into the combustion chamber; and a fuel supply section coupled to an outer peripheral surface of the nozzle casing and configured to supply the fuel to the nozzle through the outer peripheral surface of the nozzle casing.

The nozzle may include an outer tube having a cylindrical shape and defining an external appearance of the nozzle; an inner tube concentrically disposed inside the outer tube; and a swirler having an inner side coupled to an outer peripheral surface of the inner tube and an outer side coupled to an inner peripheral surface of the outer tube. The swirler may include a swirler opening coupled to the inner peripheral surface of the outer tube; a swirler plenum in which the fuel resides, the swirler plenum communicating at one end with the swirler opening; and a fuel injection port communicating with the swirler plenum to inject the fuel residing in the swirler plenum into a space between the outer tube and the inner tube. The fuel injection port may consist of a plurality of fuel injection ports spaced apart from each other and having different sizes.

Each region of the nozzle unit may further include a fuel plenum formed in the nozzle casing and configured to receive the fuel supplied to the nozzle from the fuel supply section; and an air plenum formed in the nozzle casing toward the combustion chamber and configured to receive a portion of the air supplied to the nozzle unit, the portion of the supplied air being drawn into the air plenum through a first opening formed in the nozzle casing, and each region may further include a partition wall separating the fuel plenum and the air plenum.

Each region of the nozzle unit may further include a plate located on a path in which the air introduced into the air plenum is discharged to the combustion chamber, the plate having a hole through which the air passes. The plate may consist of a plurality of plate members spaced apart from each other.

The fuel plenum and the air plenum may be spaced apart from each other. Here, the nozzle casing may include a surface facing in the axial direction of the nozzle and forming an axially arranged wall of the air plenum that faces toward the fuel plenum. The air introduced to the air plenum may include air entering through a second opening formed in the axially arranged wall of the air plenum. The fuel plenum may have an annular shape corresponding to the nozzle.

The fuel supply section may include a fuel channel that has an arc shape corresponding to an angle created by the radial partitioning of the regions of the nozzle unit and is spaced apart from the outer peripheral surface of the nozzle casing; a first fuel supply pipe having a first end communicating with the fuel channel and a second end communicating with one region of the nozzle unit; a second fuel supply pipe configured to receive a supply of the fuel and coupled to the fuel channel to deliver the supply of the fuel to the fuel channel. Fuel residing in the fuel channel may be delivered through the first fuel supply pipe to the nozzle unit. Here, the second fuel supply pipe may be coupled to the fuel channel in a radial direction of the combustor or in an axial direction of the combustor.

The fuel supplied to the nozzle may travel an independent fuel path for each region of the radially partitioned nozzle unit, the independent fuel path including a sequential connection of the second fuel supply pipe, the fuel channel, the first fuel supply pipe, the fuel plenum, and the swirler plenum.

The nozzle casing may have a pie-shaped cross section including a concave inner arc that corresponds to a convex outer arc of the outer peripheral surface of the nozzle casing; and straight sides respectively connecting the concave inner arc and the convex outer arc and forming an angle created by the radial partitioning of the regions of the nozzle unit.

In accordance with another aspect of the present disclosure, there is provided a gas turbine combustor including a combustion chamber coupled to a nozzle unit that is radially partitioned into a plurality of regions. Each region of the nozzle unit may include a nozzle casing; a nozzle supplied with fuel and air to produce a mixed gas of the fuel and the air and configured to be inserted into the nozzle casing and to inject the mixed gas into the combustion chamber, the nozzle including an outer tube defining an external appearance of the nozzle, an inner tube that is disposed inside the outer tube and has a smaller diameter than the outer tube, and a plurality of swirlers each of which has one side coupled to an inner peripheral surface of the outer tube and another side coupled to an outer peripheral surface of the inner tube; a fuel supply section coupled to an outer peripheral surface of the nozzle casing and configured to supply the fuel to the nozzle through the outer peripheral surface of the nozzle casing, the fuel supply section including a first fuel supply pipe coupled to the nozzle unit, and a fuel channel that is connected to the first fuel supply pipe and has an arc shape corresponding to an angle created by the radial partitioning of the regions of the nozzle unit; a fuel plenum in which fuel from the fuel supply section resides, the fuel plenum formed in the nozzle casing so as to communicate with the first fuel supply pipe; and an air plenum in which a portion of the air supplied to the nozzle unit resides, the air plenum separated from the fuel plenum and formed in the nozzle casing toward the combustion chamber so as to communicate with a space between the nozzle casing and a casing of the nozzle unit surrounding the nozzle casing. The nozzle casing may have at least one opening formed to introduce the air into the air plenum.

The nozzle casing may have a pie-shaped cross section including a concave inner arc that corresponds to a convex outer arc of the outer peripheral surface of the nozzle casing, and the air plenum may be separated from the fuel plenum by a partition wall. In this case, the at least one opening formed to introduce the air into the air plenum may include a plurality of first openings formed in the convex outer arc of the outer peripheral surface of the nozzle casing.

On the other hand, the air plenum and the fuel plenum may be spaced apart from each other, and the nozzle casing may include a surface facing in the axial direction of the nozzle and forming an axially arranged wall of the air plenum that faces toward the fuel plenum. In this case, the at least one opening formed to introduce the air into the air plenum may further include a plurality of second openings formed in the axially arranged wall of the air plenum.

In accordance with another aspect of the present disclosure, there is provided a gas turbine including at least one combustor, each of which is consistent with the above-described gas turbine combustor.

It is to be understood that both the foregoing general description and the following detailed description of the present disclosure are exemplary and explanatory and are intended to provide further explanation of the disclosure as claimed.

BRIEF DESCRIPTION OF THE DRAWINGS

The above and other objects, features and other advantages of the present disclosure will be more clearly understood from the following detailed description taken in conjunction with the accompanying drawings, in which:

FIG. 1 is a cutaway perspective view of a gas turbine in which may be applied a gas turbine combustor according to the present disclosure;

FIG. 2 is a sectional view of an example of a combustor of the gas turbine of FIG. 1;

FIG. 3 is a cutaway perspective view illustrating a nozzle unit of a gas turbine combustor according to a first embodiment of the present disclosure;

FIG. 4 is a top view of the nozzle unit of FIG. 3;

FIG. 5 is a cross-sectional schematic view of a portion of the nozzle unit of FIG. 3;

FIG. 6 is a perspective view of the swirler of FIG. 3;

FIG. 7 is a perspective view of the plate of FIG. 3;

FIGS. 8A to 8C are perspective views of a nozzle casing according to first to third embodiments of the present disclosure, respectively;

FIGS. 9A to 9C are transparent perspective views of FIGS. 8A to 8C, respectively;

FIG. 10A is a schematic view of a fuel conditioner and associated components according to a fourth embodiment of the present disclosure;

FIG. 10B is a schematic view of a fuel conditioner and associated components according to a fifth embodiment of the present disclosure;

FIG. 10C is a top view of the fuel conditioner configuration according to the fourth or fifth embodiment of the present disclosure;

FIG. 11A is a schematic view of a fuel conditioner and associated components according to a sixth embodiment of the present disclosure;

FIG. 11B is a schematic view of a fuel conditioner and associated components according to a seventh embodiment of the present disclosure;

FIGS. 11C to 11H are top views of the fuel conditioner configuration according to the sixth or seventh embodiment of the present disclosure;

FIG. 12A is a schematic view of a fuel conditioner and associated components according to an eighth embodiment of the present disclosure;

FIG. 12B is a schematic view of a fuel conditioner and associated components according to a ninth embodiment of the present disclosure; and FIGS. 12C to 12H are top views of the fuel conditioner configuration according to the eighth or ninth embodiment of the present disclosure.

DESCRIPTION OF SPECIFIC EMBODIMENTS

Exemplary embodiments of the present disclosure will be described below in more detail with reference to the accompanying drawings. The present disclosure may, however, be embodied in different forms and should not be construed as limited to the embodiments set forth herein. Rather, these embodiments are provided so that this disclosure will be thorough and complete, and will fully convey the scope of the present disclosure to those skilled in the art. Throughout the disclosure, like reference numerals refer to like parts throughout the various figures and embodiments of the present disclosure.

The thermodynamic cycle of a gas turbine ideally follows a Brayton cycle. The Brayton cycle consists of four phases including isentropic compression (adiabatic compression), isobaric heat addition, isentropic expansion (adiabatic expansion), and isobaric heat dissipation. In other words, in the Brayton cycle, thermal energy is released by combustion of fuel in an isobaric environment after the atmospheric air is drawn in and compressed to a high pressure, hot combustion gas is expanded to be converted into kinetic energy, and exhaust gas with residual energy is then discharged to the atmosphere. The Brayton cycle consists of four processes, i.e., compression, heating, expansion, and exhaust.

As illustrated in FIG. 1, a gas turbine 1000 applies the Brayton cycle and includes a compressor 1100, a combustor 1200, and a turbine 1300.

The compressor 1100 of the gas turbine 1000 serves to draw and compress air, and mainly serves to supply cooling air to the high-temperature region required for cooling in the gas turbine 1000 while supplying compressed air to the combustor 1200. Since the air drawn into the compressor 1100 is subject to an adiabatic compression process, the pressure and temperature of the air passing through the compressor 1100 increase.

FIG. 2 illustrates an example of the combustor 1200 included in the gas turbine 1000. The combustor 1200 mixes the compressed air, which is supplied from the outlet of the compressor 1100, with fuel for isobaric combustion to produce high-energy combustion gas. The combustor 1200 is disposed downstream of the compressor 1100 and includes a nozzle assembly 1220 having a plurality of nozzles 300 arranged in an annular combustor casing 1210. The fuel injected from each of the nozzles 300 is mixed with air at a ratio suitable for combustion.

The gas turbine 1000 may use gas fuel, liquid fuel, or composite fuel combining them. That is, various types of fluid fuel may be used.

Premixed combustion may occur in the combustor 1200. The premixed combustion is a method of premixing fuel and air prior to ignition and then injecting the mixed gas through the nozzles 300 to be ignited and burned.

In this case, a swirler (described later) may be installed in each of the nozzles 300 to facilitate the premixing of air and fuel. The premixed gas is initially ignited by an igniter, and the combustion is then maintained by continuously supplying a mixture of fuel and air.

The combustor 1200 needs to be suitably cooled since it operates at the highest temperature in the gas turbine 1000. For this, an annular tube 1280 is provided to connect the nozzle assembly 1220 to the turbine 1300. Cooling is achieved when compressed air flows along the annular tube 1280, which is essentially a duct assembly formed of a liner 1250, a transition piece 1260, and a flow sleeve 1270 surrounding the liner 1250 and the transition piece 1260. In the process in which the compressed air flows along the annular tube 1280 to be supplied to the nozzles 300, the liner 1250 and transition piece 1260, which are heated by the hot combustion gas in a combustion chamber 200, are properly cooled.

The high-temperature and high-pressure combustion gas produced in the combustor 1200 is supplied to the turbine 1300 through the duct assembly. In the turbine 1300, the thermal energy of combustion gas is converted into mechanical energy to rotate the rotary shaft of the turbine 1300 by applying impingement and reaction force to a plurality of blades radially arranged on the rotary shaft of the turbine 1300 through the adiabatic expansion of the combustion gas. Some of the mechanical energy obtained from the turbine 1300 is supplied as energy required for compression of air in the compressor, and the remainder is used as effective energy required for driving a generator to produce electric power or the like.

First Embodiment

The combustor 1200 according to the first embodiment of the present disclosure includes a nozzle unit 100 in which fuel and air are mixed for injection, and the combustion chamber 200 in which the premixed gas ejected from the nozzle unit 100 is burned.

As illustrated in FIG. 3, the nozzle unit 100 includes a nozzle unit casing 102 having a cylindrical shape and defining an overall external appearance of the nozzle unit 100, a plurality of nozzles 300 for jetting a mixed gas of fuel and air, a nozzle casing 400 having an opening for insertion of each of the nozzles 300, and a fuel supply section 500 for supplying fuel to each of the nozzles 300. In the present embodiment, the nozzle unit casing 102 may correlate to the annular combustor casing 1210 shown in FIG. 2.

As illustrated in FIG. 4, the nozzle unit 100 is partitioned radially into a plurality of regions. Each of the partitioned regions includes one nozzle 300, such that the number of regions corresponds to the number of nozzles 300. The regions may each have a wedge or pie shape, and while the angled sides of each region typically form an equal angle according to the number of regions, the form of the respective regions is not necessarily the same as one another. Although the nozzle unit 100 is partitioned into five regions in the present embodiment, it may be partitioned into fewer than or more than five regions.

In spite of the partitioning of the nozzle unit 100, the nozzle unit casing 102 is integrally formed and is not partitioned.

As the nozzle unit 100 is partitioned into a plurality of regions, the nozzle casing 400 and the fuel supply section 500 are also partitioned together. That is, the nozzle casing 400 may consist of a plurality of separately formed nozzle casings according to region, which may be referred to as a corresponding plurality of sectors of the nozzle casing 400. Similarly, the fuel supply section 500 may consist of a plurality of separately provided fuel supply sections each with its own independent fuel supply path established according to region as a result of the radial partitioning.

By the partitioning as described above, each of the nozzles 300 is supplied with fuel from the independent fuel supply path of the fuel supply section 500. That is, any nozzle has a fuel supply path separated from that of the other nozzles.

Each of the nozzles 300 has a cylindrical shape over most of its axial length and is inserted into the associated nozzle casing 400 whose axial length does not necessarily coincide with that of the inserted nozzle 300. Accordingly, a portion of the inserted nozzle 300 may protrude from the nozzle casing 400.

Hereinafter, each component of the nozzle 300 will be described in detail.

With reference to FIGS. 3-6, the nozzle 300 includes a cylindrical outer tube 310 which is open at both ends, a cylindrical inner tube 320 which is concentrically disposed in the cavity of the outer tube 310 and has one closed end facing the combustion chamber 200, and a swirler 330 having an inner side coupled to the outer peripheral surface of the inner tube 320 and an outer side coupled to the inner peripheral surface of the outer tube 310. Thus, the swirler 330 is disposed in a space between opposing surfaces of the outer and inner tubes 310 and 320.

The outer tube 310 defines the external appearance of the nozzle 300, and fuel is supplied to the nozzle 300 through the outer peripheral surface of the outer tube 310.

The inner tube 320 has a center coinciding with the outer tube 310 and is fixed in the cavity of the outer tube 310. The inner tube 320 may be supported by the swirler 330 positioned between the outer tube 310 and the inner tube 320.

The swirler 330 serves to inject fuel and simultaneously to facilitate the mixing of the injected fuel and air. As illustrated in FIG. 6, the swirler 330 includes a swirler plenum 332 as a space in which fuel resides, a swirler opening 334 for delivering fuel to the swirler plenum 332, and a fuel injection port 336 for injecting fuel from the swirler plenum 332 into the space between the outer and inner tubes 310 and 320.

The swirler plenum 332 is filled with fuel delivered from the swirler opening 334. In this case, the swirler opening 334 may have a shape and size corresponding to the swirler plenum 332 for uniform distribution of fuel. The swirler opening 334 is formed on the side where the swirler 330 is coupled to the outer tube 310.

The fuel injection port 336 is formed on at least one side of the swirler 330 to inject fuel toward the space between the outer tube 310 and the inner tube 320. In one swirler 330, the fuel injection port 336 may consist of a plurality of fuel injection ports having different sizes.

Hereinafter, the structure and operation of the nozzle casing 400 according to the first embodiment will be described with reference to FIGS. 8A and 9A.

The entire nozzle casing 400, that is, the structure including all the radially portioned regions, has a cylindrical shape, but each of the separately formed nozzle casings has a pie-shaped cross section that includes a concave inner arc corresponding to a convex outer arc of the outer peripheral surface of the nozzle casing 400, and a pair of straight sides respectively connecting the concave inner arc and the convex outer arc and forming the angle created by the radial partitioning of the regions of the nozzle unit 100.

Each nozzle casing 400 has openings formed at both ends for insertion of the associated nozzle 300.

The nozzle casing 400 includes a partition wall 411 separating its internal space into two spaces, namely, a fuel plenum 410 and an air plenum 420. The partition wall 411 is disposed in a direction perpendicular to the axial direction of the nozzle casing 400 and extends over a cross-section of the nozzle casing 400 excluding an opening for insertion of the nozzle 300. Thus, complete spatial separation between the fuel plenum 410 and the air plenum 420 is achieved only when the nozzle 300 is inserted into the nozzle casing 400. In other words, when the nozzle 300 is inserted into the nozzle casing 400, it is impossible for fuel to flow between the fuel plenum 410 and the air plenum 420.

As illustrated in FIGS. 3 and 5, the fuel plenum 410 is located toward the fuel supply section 500 and occupies a position in the nozzle casing 400 on the side opposite to the combustion chamber 200. The air plenum 420 occupies a position in the nozzle casing 400 on the side facing the combustion chamber 200.

The fuel plenum 410 is a space in which the fuel delivered from the fuel supply section 500 resides, and fuel is uniformly distributed throughout the space. The fuel plenum 410 allows a uniform amount of fuel to be supplied to the nozzle 300.

The air plenum 420 is a space in which some of the air delivered from the compressor resides, and at least one first opening 422 is formed in the outer peripheral surface of the nozzle casing 400 at a position so as to communicate with the air plenum 420. Thus, air may be introduced into the air plenum 420 through the first opening 422. In this case, the first opening 422 may consist of a plurality of first openings having different sizes. However, in spite of the first opening 422, most of the air delivered from the compressor to the combustor is supplied to the nozzle 300.

The air plenum 420 has one end facing the combustion chamber 200, and a plate 440 formed with a hole 441 is disposed in the air plenum 420 toward the end facing the combustion chamber 200. Since the plate 440 is exposed to high-temperature combustion gas, it is necessary to cool the plate 440 for preventing its damage. Accordingly, the first opening 422 is formed in an appropriate position and size according to the flow rate of air required to cool the plate 440.

The air plenum 420 is filled with the air introduced through the first opening 422. In this case, due to the difference in temperature between the air residing in the air plenum and that residing in the plate 440, heat is transferred to the air plenum 420 to cool the plate 440. That is, the air plenum 420 serves to cool the plate 440, and the air residing in the air plenum 420 cools the plate 440 and is then discharged to the combustion chamber 200 through the hole 441 of the plate 440.

As illustrated in FIG. 7, the plate 440 may be a multistage plate including a first plate member 442 and a second plate member 444. In the flow direction of air, the first plate member 442 is located upstream and the second plate member 444 is located downstream. That is, air first flows through the first plate member 442. Then, the air impinges on the second plate member 444 after passing through the hole 441 of the first plate member 442 and flows to the combustion chamber 200 through the hole 441 of the second plate member 444. In this case, the holes formed in the first and second plates 442 and 444 are staggered so as not to coincide with each other in the flow direction of air. However, in some cases, the first plate member 442 may be omitted such that air in the air plenum 420 first impinges on the second plate member 444. That is, in some cases, the plate 440 may not include the first plate member 442 and may include only the second plate member 444 disposed toward the combustion chamber 200.

The fuel supply section 500 supplies fuel to the nozzle 300 and is coupled to the outer peripheral surface of the nozzle casing 400. The fuel supply section 500 includes a first fuel supply pipe 510, a fuel channel 520, and a second fuel supply pipe 530.

The first fuel supply pipe 510 is directly coupled to the outer peripheral surface of the nozzle casing 400 for each region of the nozzle unit 100. That is, the number of first fuel supply pipes 510 may be greater than or equal to the number of nozzles 300.

The fuel channel 520 has an arc shape corresponding to the angle created by the radial partitioning of the regions of the nozzle unit 100 and is spaced apart from the outer peripheral surface of the nozzle casing 400 by a certain distance. The nozzle casing 400 and the fuel channel 520 are respectively connected to opposite ends of the first fuel supply pipe 510. The fuel channel 520 has a space in which fuel stays. That is, the fuel channel 520 serves not to simply supply fuel but to temporarily hold fuel and appropriately control the flow rate, the pressure, or the like thereof for the uniform distribution of the fuel supplied to the nozzle 300.

The second fuel supply pipe 530 supplies fuel to the fuel channel 520. The second fuel supply pipe 530 may be connected to the outer peripheral surface of the fuel channel 520 and may extend from the fuel channel 520 in the radial (FIG. 3) or radial (FIG. 4) direction of the nozzle unit 100.

In the nozzle unit 100 as described above, the fuel delivery path is as follows.

First, the fuel is uniformly distributed in the fuel channel 520 where it resides after having passed through the second fuel supply pipe 530. The fuel is delivered from the fuel channel 520 to the fuel plenum 410 through the first fuel supply pipe 510 and becomes uniformly distributed in the fuel plenum 410 where it subsequently resides. The fuel is then delivered from the fuel plenum 410 to the swirler plenum 332 through the swirler opening 334. Finally, the fuel is injected from the swirler plenum 332 through the fuel injection port 336 into the space between the outer and inner tubes 310 and 320. The injected fuel is mixed with air to become a mixed gas, and the mixed gas is burned in the combustion chamber 200. In this case, the swirler 330 functions to facilitate the uniform mixing of fuel and air.

In the nozzle unit 100, the delivery path of air compressed by the compressor is as follows.

The air flowing from the compressor to the combustor passes through the space between the nozzle casing 400 and the nozzle unit casing 102. When the flowing air reaches the upper end of the nozzle unit 100, its flow direction is reversed by 180 degrees to be introduced into the nozzle 300. The air introduced into the nozzle 300 is mixed with the fuel injected from the swirler 330 located in the space within the nozzle so that the mixture is injected into the combustion chamber 200.

In this case, some of the air flowing through the space between the nozzle casing 400 and the nozzle unit casing 102 is drawn through the first opening 422 to be drawn into the air plenum 420 as described above. The air introduced into the air plenum 420 serves to cool the plate 440 as described above.

The operation and effect according to the first embodiment of the present disclosure are as follows.

As the nozzle unit 100 is partitioned radially into a plurality of regions, the nozzle unit 100 can be easily assembled and disassembled. In addition, when the maintenance of the nozzle 300 or the like is required for a certain region among the plurality of regions, only that region can be separated, thereby improving the convenience of the maintenance.

Since the fuel supply section 500 is located at the relatively wide periphery of the nozzle unit 100 rather than in the smaller area of its central portion, the design of the fuel supply path is simplified.

Since the distribution of fuel is uniformly maintained by the fuel plenum 410, the amount of injected fuel is constant everywhere so that fuel and air is smoothly mixed.

Since the distribution of air is uniformly maintained by the air plenum 420, the nozzle 300 can be effectively cooled.

Second Embodiment

According to the second embodiment illustrated in FIGS. 8B and 9B, a nozzle casing 400' includes an upper side where a fuel plenum is located and a lower side where an air plenum is located, the air plenum having a predetermined thickness. That is, the fuel plenum and the air plenum are spaced apart from each other, and the nozzle casing 400' does not occupy the interceding space.

The structure and role of the fuel plenum in the second embodiment are the same as those in the first embodiment. However, the second embodiment differs from the first embodiment in that the air plenum is reduced in height to occupy only a portion of the lower side of the nozzle unit 100. The air plenum of the second embodiment has at least one first opening 422' formed in its outer peripheral surface and at least one second opening 404' formed so as face in the axial direction of the nozzle 300. Here, the air plenum of the second embodiment has an upper wall facing the fuel plenum, and the second opening 404' is formed in the upper wall so as to face toward the fuel plenum. The second opening 404' may consist of a plurality of second openings having different sizes. The second opening 404' may be provided to the nozzle casing 400' in addition to the first opening 422' or in lieu of the first opening 422'.

The air delivery path according to the structure of the nozzle casing 400' will be described with reference to FIG. 9B.

As in the first embodiment, the air flowing from the compressor to the combustor according to the second embodiment passes through the space between the nozzle casing 400' and the nozzle unit casing 102. In the case of the second embodiment, however, since the nozzle casing 400' is formed only on upper and lower sides of the nozzle 300, the air flowing from the compressor is in direct contact with the outer tube 310 as it continues to flow upward. When the flowing air reaches the upper end of the nozzle unit 100, its flow direction is reversed by 180 degrees to be introduced into the nozzle 300. Before its introduction into the nozzle unit 100, however, some the air passing over the outer tube 310 flows downward and is drawn into the air plenum through the second opening 404'. Lastly, as described in relation to the first embodiment, air residing in the air plenum cools the plate 440 exposed to high-temperature combustion gas and is discharged to the combustion chamber 200 through the hole 441 of the plate 440.

With reference to FIGS. 9A and 9B, the operation and effect according to the second embodiment of the present disclosure will be described by its comparison with the first embodiment.

In the first embodiment, the nozzle casing 400 surrounds most of the outer peripheral surface of the nozzle 300. The flow of air upward is not uniform in the circumferential direction of a given sector of the nozzle casing 400. Due to this non-uniform flow of air when the air is introduced into the inlet of the nozzle 300, the degree of mixing of air and fuel in the nozzle is poor, resulting in an increase in NOx, the level of which is a major factor in the performance of the combustor.

On the other hand, in the second embodiment, the nozzle casing 400' is present only on a portion of the periphery of the nozzle 300, namely, on the upper and lower sides of the nozzle 300. Thus, most of the outer peripheral surface of the nozzle 300 is subject to an open space that is uniformly filled with the air compressed by the compressor by a uniform distribution of the air being introduced into the inlet of the nozzle 300. Therefore, with the open space acting as a plenum upstream of the inlet of the nozzle 300, since air and fuel are uniformly mixed in the nozzle, the performance of the combustor is enhanced.

Third Embodiment

According to the third embodiment illustrated in FIGS. 8C and 9C, a nozzle casing 400" includes a fuel plenum having an annular shape corresponding to the nozzle 300. The fuel plenum of the third embodiment has a shape different from that of the first and second embodiments whose fuel plenums have the same shape as the given sector of the nozzle casing 400. Thus, the overall volume of the fuel plenum of the third embodiment may be somewhat reduced.

First and second openings 422" and 404" formed in the air plenum are the same as those described in the second embodiment.

The operation and effect according to the third embodiment of the present disclosure are as follows.

Since the fuel plenum of the third embodiment has a circular cross-section rather than that of the pie shape of the above-described embodiments, a uniform distribution of fuel can be expected in the fuel plenum of the nozzle casing 400" over its entire circumference. Slight variations in the flow of air may exist, but the third embodiment can have an effect similar to that described for the second embodiment.

In addition, the fuel plenum 410 of the present disclosure may further include a fuel conditioner (described later) as a means for guiding the path of fuel in order to control the fuel's flow rate, pressure, directionality, or the like. Such a fuel conditioner may be provided to achieve improved uniformity at the fuel injection port 336. A fuel conditioner disposed between the outer tube 310 and the fuel supply section 500 can achieve uniform distribution of fuel at the fuel plenum 410 and the swirler plenum 332 and uniform injection of fuel at each of the fuel injection ports 336. According to an embodiment of the present disclosure, the fuel conditioner disposed between the outer tube 310 and the fuel supply section 500 is formed in the fuel plenum 410, which forms an upper space of the nozzle casing 400, and is disposed along a circumferential direction of the nozzle 300. Thus, an annular passage for the fuel to flow through is formed between the fuel conditioner and the outer tube 310 of the nozzle 300, which are spaced apart from each other.

In the below description of embodiments of the fuel conditioner, it should be understood that terms implying relative directionality, including "upper side," "lower side," "upward," "downward," and the like, refer to directions in the drawings for convenience of description only. That is, such terms are not necessarily intended to convey a meaning of absolute directions in the embodiments of the present disclosure.

Fourth Embodiment

As illustrated in FIG. 10A, the fourth embodiment of the present disclosure includes a fuel conditioner 412*a* disposed between the outer tube 310 and the fuel supply section 500. The fuel conditioner 412*a* extends from an upper side (e.g., a first side) of the fuel plenum 410 toward a lower side (e.g., a second side opposite to the first side) of the fuel plenum 410, such that the fuel conditioner 412*a* includes an open lower side.

In this configuration, fuel from the fuel supply section 500 impinges on the fuel conditioner 412*a* to be directed downward toward its open lower side. The fuel, passing through the open lower side of the fuel conditioner 412*a* between the outer tube 310 and the fuel supply section 500, then flows upward in a first passage 414*a* between the fuel conditioner 412*a* and the outer tube 310 before entering the swirler plenum 332.

Fifth Embodiment

As illustrated in FIG. 10B, the fifth embodiment of the present disclosure includes a fuel conditioner 412*aa* disposed between the outer tube 310 and the fuel supply section 500. The fuel conditioner 412*aa* extends from a lower side of the fuel plenum 410 toward an upper side of the fuel plenum 410, such that the fuel conditioner 412*aa* includes an open upper side between the outer tube 310 and the fuel supply section 500.

In this configuration, fuel from the fuel supply section 500 impinges on the fuel conditioner 412*aa* to be directed upward toward its open upper side. The fuel, passing through the open upper side of the fuel conditioner 412*aa* between the outer tube 310 and the fuel supply section 500, then flows downward in a first passage 414*aa* between the fuel conditioner 412*aa* and the outer tube 310 before entering the swirler plenum 332.

FIG. 10C schematically illustrates the fuel conditioner configuration according to the fourth and fifth embodiments when viewed from the top. That is, the fuel conditioner 412*a* (412*aa*) is located outside the outer tube 310 defining the external appearance of the nozzle 300, and fuel flows into the first passage 414*a* (414*aa*) between the fuel conditioner 412*a* (412*aa*) and the outer tube 310.

Sixth Embodiment

As illustrated in FIG. 11A, the sixth embodiment of the present disclosure includes a fuel conditioner 412*b* disposed between the outer tube 310 and the fuel supply section 500. The fuel conditioner 412*b* extends from an upper side of the fuel plenum 410 toward a lower side of the fuel plenum 410, such that the fuel conditioner 412*b* includes an open lower side. In this embodiment, the fuel conditioner 412*b* includes a bend at its lower end and an extension 413*b* that extends from the bend, inwardly, toward a surface of the outer tube 310. That is, the extension 413*b* does not contact the outer tube 310. The extension 413*b* defines a second passage 414*b* as an inlet to a space that is arranged on a downstream side of the fuel conditioner 412*b* and communicates with the swirler plenum 332.

In this configuration, fuel from the fuel supply section 500 impinges on the fuel conditioner 412*b* to be directed downward toward its open lower side. The fuel, passing through the open lower side of the fuel conditioner 412*b* and passing over the extension 413*b*, then flows upward through the second passage 414*b* in order to enter the swirler plenum 332.

Seventh Embodiment

As illustrated in FIG. 11B, the seventh embodiment of the present disclosure includes a fuel conditioner 412*bb* disposed between the outer tube 310 and the fuel supply section 500. The fuel conditioner 412*bb* extends from a lower side of the fuel plenum 410 toward an upper side of the fuel plenum 410, such that the fuel conditioner 412*bb* includes an open upper side. In this embodiment, the fuel conditioner 412*b* includes a bend at its upper end and an extension 413*bb* that extends from the bend, inwardly, toward a surface of the outer tube 310. That is, the extension 413*bb* does not contact the outer tube 310. The extension 413*bb* defines a second passage 414*bb* as an inlet to a space that is arranged on a downstream side of the fuel conditioner 412*bb* and communicates with the swirler plenum 332.

In this configuration, fuel from the fuel supply section 500 impinges on the fuel conditioner 412*bb* to be directed upward toward its open upper side. The fuel, passing through the open upper side of the fuel conditioner 412*b* and passing over the extension 413*bb*, then flows downward through the second passage 414*bb* in order to enter the swirler plenum 332.

FIGS. 11C to 11H schematically illustrate the fuel conditioner configuration according to the sixth and seventh embodiments when viewed from the top. That is, the fuel conditioner 412*b* (412*bb*) is located outside the outer tube 310 defining the external appearance of the nozzle 300. Entry to the space behind the second passage 414*b* (414*bb*) is partially blocked by the extension 413*b* (413*bb*), which may vary in size along the circumferential direction of the outer tube 310. The second passage 414*b* (414*bb*) may have variously shaped cross sections and may, for example, be an annular passage (e.g., FIG. 11C), be formed such that straight sides connect at an angle (e.g., FIGS. 11D, 11E, 11G), be formed such that straight sides are connected by a curved shape (e.g., FIG. 11F), or be formed only of curved sides (e.g., FIG. 11H). In addition to the configurations illustrated in FIGS. 11C to 11H, the second passage 414*b* (414*bb*) may be variously embodied within the technical scope of the present disclosure.

Eighth Embodiment

As illustrated in FIG. 12A, the eighth embodiment of the present disclosure includes a fuel conditioner 412*c* disposed between the outer tube 310 and the fuel supply section 500. The fuel conditioner 412*c* extends from an upper side of the fuel plenum 410 toward a lower side of the fuel plenum 410, such that the fuel conditioner 412*c* includes an open lower side. In this embodiment, the fuel conditioner 412*c* includes a bend at its lower end; a first extension 413*c* that extends from the bend, inwardly, toward a surface of the outer tube 310; and a second extension 415*c* that protrudes from the surface of the outer tube 310 to face the first extension 413*c*. Here, the second extension 415*c* does not contact the first extension 413*c*. Together, the first and second extensions 413*c* and 415*c* define a third passage 414*c* as an inlet to a space that is arranged on a downstream side of the fuel conditioner 412*c* and communicates with the swirler plenum 332.

In this configuration, fuel from the fuel supply section 500 impinges on the fuel conditioner 412*c* to be directed downward toward its open lower side. The fuel passes through the open lower side of the fuel conditioner 412*c* and the third passage 414*c* and continues upward in order to enter the swirler plenum 332.

Ninth Embodiment

As illustrated in FIG. 12B, the ninth embodiment of the present disclosure includes a fuel conditioner 412*cc* disposed between the outer tube 310 and the fuel supply section 500. The fuel conditioner 412*cc* extends from a lower side of the fuel plenum 410 toward an upper side of the fuel plenum 410, such that the fuel conditioner 412*cc* includes an open upper side. In this embodiment, the fuel conditioner 412*cc* includes a bend at its upper end; a first extension 413*cc* that extends from the bend, inwardly, toward a surface of the outer tube 310; and a second extension 415*cc* that protrudes from the surface of the outer tube 310 to face the first extension 413*cc*. Here, the second extension 415*cc* does not contact the first extension 413*cc*. Together, the first and second extensions 413*cc* and 415*cc* define a third passage 414*cc* as an inlet to a space that is arranged on a downstream side of the fuel conditioner 412*cc* and communicates with the swirler plenum 332.

In this configuration, fuel from the fuel supply section 500 impinges on the fuel conditioner 412*cc* to be directed upward toward its open upper side. The fuel passes through the open upper side of the fuel conditioner 412*cc* and the third passage 414*cc* and continues downward in order to enter the swirler plenum 332.

FIGS. 12C to 12H schematically illustrate the fuel conditioner configuration according to the eight and ninth embodiments when viewed from the top. That is, the fuel conditioner 412*c* (412*cc*) is located outside the outer tube 310 defining the external appearance of the nozzle 300. Entry to the space behind the third passage 414*c* (414*cc*) is partially blocked by the first and second extensions 413*c* and 415*c* (413*cc* and 415*cc*), one or both of which may vary in size along the circumferential direction of the outer tube 310. The third passage 414*c* (414*cc*) may have variously shaped cross sections and may, for example, be an annular passage (e.g., FIG. 12C), or be circular (e.g., FIG. 12D) or polygonal (e.g., FIGS. 12E-12H). In the embodiments of FIG. 12D through FIG. 12H, the first and second extensions 413*c* and 415*c* (413*cc* and 415*cc*) effectively form an integral extension that extends to the outer tube 310. In addition to the configurations illustrated in FIGS. 12C to 12H, the third passage 414*c* (414*cc*) may be variously embodied within the technical scope of the present disclosure.

According to the fourth to ninth embodiments of the present disclosure described above, the fuel conditioner is formed to interfere with the linear flow of fuel, with the consequence that the flow rate of the fuel is reduced while the fuel flows through a passage having a serpentine configuration. Therefore, the distribution of the fuel drawn into the swirler plenum 332 can be maintained uniformly. Furthermore, when the fuel is injected through the fuel injection ports 336, it is possible to prevent a variation in the fuel's flow rate, pressure, or the like for each of the fuel injection ports 336.

As is apparent from the above description, it is possible to easily assemble and disassemble the nozzle by radially partitioning the nozzle and associated components into a plurality of regions in the gas turbine combustor according to the present disclosure.

In addition, it is possible to simplify the fuel supply path by supplying fuel from the outer periphery of the nozzle and utilizing a wide space. Therefore, it is possible to minimize the leakage of fuel.

Furthermore, since spaces are provided in which fuel and air can reside, it is possible to improve uniformity in the distribution of fuel and air. Therefore, the combustion is smoothly performed.

While the present disclosure has been described with respect to the specific embodiments, it will be apparent to those skilled in the art that various changes and modifications may be made without departing from the spirit and scope of the disclosure as defined in the following claims.

What is claimed is:

1. A gas turbine combustor comprising a combustion chamber coupled to a nozzle unit that is radially partitioned into a plurality of regions, each region of the nozzle unit comprising:

a nozzle casing;

a nozzle supplied with fuel and air to produce a mixed gas of the fuel and the air and configured to be inserted into the nozzle casing and to inject the mixed gas into the combustion chamber;

a fuel supply section coupled to an outer peripheral surface of the nozzle casing and configured to supply the fuel to the nozzle through the outer peripheral surf ace of the nozzle casing; and an air plenum formed in the nozzle casing toward the combustion chamber and configured to receive a portion of the air supplied to the nozzle unit, the portion of the air being drawn into the air plenum through a first opening formed in the nozzle casing, wherein the fuel supply section comprises a fuel channel that has an arc shape corresponding to an angle created by the radial partitioning of the regions of the nozzle unit and unit, is spaced apart from the outer peripheral surface of the nozzle casing, and has a space in which the fuel stays, wherein the fuel supply section further comprises a first fuel supply pipe having a first end communicating with the fuel channel and a second end communicating with one region of the plurality of regions of the nozzle unit, wherein the fuel supply section further comprises a second fuel supply pipe configured to receive a supply of the fuel and coupled to the fuel channel to deliver the supply of the fuel to the fuel channel, wherein the fuel residing in the fuel channel is delivered through the first fuel supply pipe to the nozzle unit, wherein each region of the nozzle unit further comprises a fuel plenum formed in the nozzle casing and configured to receive the fuel supplied to the nozzle from the fuel supply section and then to deliver the fuel to a swirler plenum of a swirler having an outer side coupled to an outer tube of the nozzle, and wherein the fuel supplied to the nozzle travels an independent fuel path for each region of the nozzle unit, the independent fuel path including a sequential connection of the second fuel supply pipe, the fuel channel, the first fuel supply pipe, the fuel plenum, and the swirler plenum.

2. The gas turbine combustor according to claim 1, wherein the nozzle comprises:

an inner tube concentrically disposed inside the outer tube, wherein the outer tube has a cylindrical shape and defines an external appearance of the nozzle, and wherein the swirler has an inner side coupled to an outer peripheral surface of the inner tube and the outer side coupled to an inner peripheral surface of the outer tube.

3. The gas turbine combustor according to claim 2, wherein the swirler comprises:

a swirler opening coupled to the inner peripheral surface of the outer tube; and a fuel injection port communicating with the swirler plenum to inject the fuel residing in the swirler plenum into a space between the outer tube and the inner tube, wherein the swirler plenum communicates at one end with the swirler opening.

4. The gas turbine combustor according to claim 3, wherein the fuel injection port consists of a plurality of fuel injection ports spaced apart from each other.

5. The gas turbine combustor according to claim 1, wherein each region of the nozzle unit further comprises a plate located on a path in which the air introduced into the air plenum is discharged to the combustion chamber, the plate having a hole through which the air passes.

6. The gas turbine combustor according to claim 5, wherein the plate consists of a plurality of plate members spaced apart from each other.

7. The gas turbine combustor according to claim 1, wherein each region of the nozzle unit further comprises a partition wall separating the fuel plenum and the air plenum.

8. The gas turbine combustor according to claim 1, wherein:

the fuel plenum and the air plenum are spaced apart from each other;

the nozzle casing includes a surface facing in an axial direction of the nozzle and forming an axially arranged wall of the air plenum that faces toward the fuel plenum; and the air introduced to the air plenum includes the air entering through a second opening formed in the axially arranged wall of the air plenum.

9. The gas turbine combustor according to claim 8, wherein the fuel plenum has an annular shape corresponding to the nozzle.

10. The gas turbine combustor according to claim 1, wherein the second fuel supply pipe is coupled to the fuel channel in a radial direction of the combustor.

11. The gas turbine combustor according to claim 1, wherein the second fuel supply pipe is coupled to the fuel channel in an axial direction of the combustor.

12. The gas turbine combustor according to claim 1, wherein the nozzle casing has a pie-shaped cross section including:

a concave inner arc that corresponds to a convex outer arc of the outer peripheral surface of the nozzle casing; and straight sides respectively connecting the concave inner arc and the convex outer arc and forming an angle created by the radial partitioning of the regions of the nozzle unit.

13. A gas turbine combustor comprising a combustion chamber coupled to a nozzle unit that is radially partitioned into a plurality of regions, each region of the nozzle unit comprising:

a nozzle casing;

a nozzle supplied with fuel and air to produce a mixed gas of the fuel and the air and configured to be inserted into the nozzle casing and to inject the mixed gas into the combustion chamber, the nozzle including an outer tube defining an external appearance of the nozzle, an inner tube that is disposed inside the outer tube and has a smaller diameter than the outer tube, and a plurality of swirlers each of which has one side coupled to an inner peripheral surface of the outer tube and another side coupled to an outer peripheral surface of the inner tube;

a fuel supply section coupled to an outer peripheral surface of the nozzle casing and configured to supply the fuel to the nozzle through the outer peripheral surface of the nozzle casing, the fuel supply section including a first fuel supply pipe coupled to the nozzle unit, and a fuel channel that is connected to the first fuel supply pipe and has an arc shape corresponding to an angle created by the radial partitioning of the regions of the nozzle unit and has a space in which the fuel stays;

a fuel plenum in which the fuel from the fuel supply section resides, the fuel plenum formed in the nozzle casing so as to communicate with the first fuel supply pipe; and an air plenum in which a portion of the air supplied to the nozzle unit resides, the air plenum separated from the fuel plenum and formed in the nozzle casing toward the combustion chamber so as to communicate with a space between the nozzle casing and a casing of the nozzle unit surrounding the nozzle casing, wherein the nozzle casing has at least one opening formed to introduce the air into the air plenum, wherein the first fuel supply pipe has a first end communicating with the fuel channel and a second end communicating with one region of the plurality of regions of the nozzle unit, wherein the fuel supply section further comprises a second fuel supply pipe configured to receive a supply of the fuel and coupled to the fuel channel to deliver the supply of the fuel to the fuel channel, wherein the fuel residing in the fuel channel is delivered through the first fuel supply pipe to the nozzle unit, wherein the fuel plenum formed in the nozzle casing is configured to receive the fuel supplied to the nozzle from the fuel supply section and then to deliver the fuel to a swirler plenum of a swirler of the plurality of swirlers, and wherein the fuel supplied to the nozzle travels an independent fuel path for each region of the nozzle unit, the independent fuel path including a sequential connection of the second fuel supply pipe, the fuel channel, the first fuel supply pipe, the fuel plenum, and the swirler plenum.

14. The gas turbine combustor according to claim 13, wherein the nozzle casing has a pie-shaped cross section including a concave inner arc that corresponds to a convex outer arc of the outer peripheral surface of the nozzle casing, and wherein the at least one opening formed to introduce the air into the air plenum includes a plurality of first openings formed in the convex outer arc of the outer peripheral surface of the nozzle casing.

15. A gas turbine comprising at least one combustor, each of the at least one combustor comprising a combustion chamber coupled to a nozzle unit that is radially partitioned into a plurality of regions, each region of the nozzle unit comprising:

a nozzle casing;

a nozzle supplied with fuel and air to produce a mixed gas of the fuel and the air and configured to be inserted into the nozzle casing and to inject the mixed gas into the combustion chamber;

a fuel supply section coupled to an outer peripheral surface of the nozzle casing and configured to supply the fuel to the nozzle through the outer peripheral surface surf ace of the nozzle casing; and an air plenum formed in the nozzle casing toward the combustion chamber and configured to receive a portion of the air supplied to the nozzle unit, the portion of the air being drawn into the air plenum through a first opening formed in the nozzle casing, wherein the fuel supply section comprises a fuel channel that has an arc shape corresponding to an angle created by the radial partitioning of the regions of the nozzle unit, is spaced apart from the outer peripheral surface of the nozzle casing, and has a space in which the fuel stays, wherein the fuel supply section further comprises a first fuel supply pipe having a first end communicating with the fuel channel and a second end communicating with one region of the plurality of regions of the nozzle unit, wherein the fuel supply section further comprises a second fuel supply pipe configured to receive a supply of the fuel and coupled to the fuel channel to deliver the supply of the fuel to the fuel channel, wherein the fuel residing in the fuel channel is delivered through the first fuel supply pipe to the nozzle unit, wherein each region of the nozzle unit further comprises a fuel plenum formed in the nozzle casing and configured to receive the fuel supplied to the nozzle from the fuel supply section and then to deliver the fuel to a swirler plenum of a swirler having an outer side coupled to an outer tube of the nozzle, and wherein the fuel supplied to the nozzle travels an independent fuel path for each region of the nozzle unit, the independent fuel path including a sequential connection of the second fuel supply pipe, the fuel channel, the first fuel supply pipe, the fuel plenum, and the swirler plenum.

* * * * *